US012171300B2

(12) United States Patent
Bailly et al.

(10) Patent No.: US 12,171,300 B2
(45) Date of Patent: Dec. 24, 2024

(54) SOLE STRUCTURE OF AN ARTICLE OF FOOTWEAR

(71) Applicant: NIKE, Inc., Beaverton, OR (US)

(72) Inventors: Devin Bailly, Beaverton, OR (US); Wade Flanagan, Portland, OR (US); Eric S. Schindler, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 105 days.

(21) Appl. No.: 16/825,294

(22) Filed: Mar. 20, 2020

(65) Prior Publication Data

US 2020/0305549 A1 Oct. 1, 2020

Related U.S. Application Data

(60) Provisional application No. 62/825,339, filed on Mar. 28, 2019.

(51) Int. Cl.
*A43B 13/18* (2006.01)

(52) U.S. Cl.
CPC ..... *A43B 13/189* (2013.01)

(58) Field of Classification Search
CPC ... A43B 13/189; A43B 13/188; A43B 13/184; A43B 13/12; A43B 13/127; A43B 13/125; A43B 21/265; A43B 21/28
See application file for complete search history.

(56) References Cited

U.S. PATENT DOCUMENTS 2,080,469 A * 5/1937 Gilbert ..... A43B 17/03 36/153
2,645,865 A * 7/1953 Town ..... A43B 17/03 36/153
4,670,995 A * 6/1987 Huang ..... B29D 35/14 36/44
5,005,299 A * 4/1991 Whatley ..... A43B 13/181 36/35 R (Continued)

FOREIGN PATENT DOCUMENTS

CN 1213672 C 8/2005
CN 100407955 C 8/2008

(Continued)

OTHER PUBLICATIONS

European Patent Office as ISA, International Search Report and Written Opinion for PCT Application No. PCT/2020/025238, mailed Jun. 26, 2020.

(Continued)

*Primary Examiner* — Heather Mangine
*Assistant Examiner* — Raquel M. Weis
(74) *Attorney, Agent, or Firm* — Honigman LLP; Matthew H. Szalach; Jonathan P. O'Brien

(57) ABSTRACT

A sole structure for an article of footwear includes a midsole and a fluid-filled chamber. The midsole includes a plurality of projections. At least one of the plurality of projections forms a first portion of a peripheral side wall of the sole structure. The fluid-filled chamber includes a central portion, (Continued)

a plurality of lobes extending outward from the central portion, and a plurality of channels formed between the plurality of lobes. A first lobe of the plurality of lobes is disposed between at least two of the plurality of projections such that the first lobe forms a second portion of the peripheral side wall of the sole structure.

18 Claims, 14 Drawing Sheets

(56) References Cited

U.S. PATENT DOCUMENTS 5,014,449 A * 5/1991 Richard ..... A43B 3/0084 36/114
5,046,267 A * 9/1991 Kilgore ..... A43B 5/00 36/31
5,185,943 A * 2/1993 Tong ..... A43B 5/00 36/27
5,337,492 A * 8/1994 Anderie ..... A43B 13/181 36/114
5,367,791 A * 11/1994 Gross ..... A43B 13/26 36/31
5,425,184 A * 6/1995 Lyden ..... A43B 13/20 36/114
5,625,964 A * 5/1997 Lyden ..... A43B 13/20 36/114
5,669,161 A * 9/1997 Huang ..... A43B 23/26 36/43
5,692,322 A * 12/1997 Lombardino ..... A43B 3/24 36/100
5,718,063 A * 2/1998 Yamashita ..... A43B 1/0072 36/28
D391,751 S * 3/1998 Santos ..... D2/961
5,753,061 A * 5/1998 Rudy ..... F16F 9/0472 428/72
5,771,606 A * 6/1998 Litchfield ..... A43B 13/203 36/71
5,794,359 A * 8/1998 Jenkins ..... A43B 13/206 36/28
5,901,467 A * 5/1999 Peterson ..... A43B 13/20 36/35 B
5,930,918 A * 8/1999 Healy ..... A43B 13/20 36/29
5,979,078 A * 11/1999 McLaughlin ..... B29D 35/142 36/35 B
6,009,637 A * 1/2000 Pavone ..... A43B 13/14 36/28
6,026,593 A * 2/2000 Harmon-Weiss .... A43B 13/181 36/35 R
6,158,149 A * 12/2000 Rudy ..... A43B 13/206 36/71
6,266,897 B1 * 7/2001 Seydel ..... A43B 13/16 36/25 R
6,374,514 B1 * 4/2002 Swigart ..... A43B 13/20 36/35 B
6,385,864 B1 * 5/2002 Sell, Jr. ..... A43B 13/20 36/35 B
6,402,879 B1 * 6/2002 Tawney ..... A43B 21/285 36/35 R
6,430,843 B1 * 8/2002 Potter ..... A43B 13/203 36/43
6,568,102 B1 * 5/2003 Healy ..... A43B 13/20 36/35 R
6,571,490 B2 * 6/2003 Tawney ..... A43B 13/20 36/35 B
6,582,786 B1 * 6/2003 Bonk ..... B32B 3/20 428/476.3
6,931,764 B2 * 8/2005 Swigart ..... A43B 13/20 36/35 B
6,962,008 B2 * 11/2005 Manz ..... A43B 13/14 36/25 R
7,076,891 B2 * 7/2006 Goodwin ..... A43B 21/32 36/35 B
7,080,467 B2 * 7/2006 Marvin ..... A43B 13/189 36/35 B
7,086,179 B2 * 8/2006 Dojan ..... A43B 21/28 36/28
7,132,032 B2 * 11/2006 Tawney ..... A43B 13/20 156/289
7,331,124 B2 * 2/2008 Meschan ..... A43B 21/26 36/35 R
7,353,625 B2 * 4/2008 Ellis ..... A43B 7/144 36/28
7,401,419 B2 * 7/2008 Lucas ..... A43B 1/0009 36/27
7,421,805 B2 * 9/2008 Geer ..... A43B 3/0057 36/31
7,451,556 B2 * 11/2008 Harmon-Weiss ..... A43B 13/20 36/35 B
7,464,489 B2 * 12/2008 Ho ..... A43B 13/181 36/35 B
7,565,754 B1 * 7/2009 Acheson ..... A43B 13/026 36/144
7,707,744 B2 * 5/2010 Schindler ..... A43B 13/20 36/29
8,225,533 B2 * 7/2012 Meschan ..... A43B 21/26 36/35 R
8,535,390 B1 * 9/2013 Lecomte ..... A61F 2/66 623/53
8,732,984 B2 * 5/2014 Ha ..... A43B 13/181 36/28
8,782,924 B2 * 7/2014 Peyton ..... A43B 13/18 36/35 B
8,839,531 B2 * 9/2014 Sullivan ..... A43B 13/127 36/28
8,844,165 B2 * 9/2014 Gishifu ..... A43B 13/189 36/35 B
8,914,998 B2 * 12/2014 Gheorghian ..... A43B 13/22 36/103
9,119,439 B2 * 9/2015 Brandt ..... B29C 51/105
9,271,543 B2 * 3/2016 Sills ..... A43B 13/181
9,510,646 B2 * 12/2016 Holt ..... A43B 13/188
9,687,044 B2 * 6/2017 Schindler ..... A43B 13/206
9,867,427 B2 * 1/2018 Fujita ..... A43B 13/26
10,070,691 B2 * 9/2018 Greene ..... A43B 13/189
11,793,271 B2 * 10/2023 Case ..... A43B 1/0009
2001/0042321 A1 * 11/2001 Tawney ..... A43B 13/20 36/43
2002/0121031 A1 * 9/2002 Smith ..... A43B 13/20 36/35 B
2003/0056400 A1 * 3/2003 Potter ..... A43B 13/143 36/88
2003/0208929 A1 * 11/2003 Lucas ..... A43B 13/186 36/28
2005/0011085 A1 * 1/2005 Swigart ..... A43B 7/144 36/31
2005/0028403 A1 * 2/2005 Swigart ..... A43B 13/20 36/28
2006/0041321 A1 * 2/2006 Christensen ..... A61F 2/6607 623/38
2006/0117604 A1 * 6/2006 Fusco ..... A43B 1/0027 36/25 R
2006/0137221 A1 * 6/2006 Dojan ..... A43B 21/28 36/29
2006/0277794 A1 * 12/2006 Schindler ..... A43B 13/187 36/28
2007/0119075 A1 * 5/2007 Schindler ..... B29C 49/48 36/35 B
2007/0169376 A1 * 7/2007 Hatfield ..... A43B 7/1415 36/35 B
2007/0220778 A1 * 9/2007 Fusco ..... A43B 13/125 36/30 R
2008/0184595 A1 * 8/2008 Schindler ..... A43B 13/20 36/29
2009/0013558 A1 * 1/2009 Hazenberg ..... A43B 13/12 36/88

(56) References Cited

U.S. PATENT DOCUMENTS

2009/0090025 A1* 4/2009 Cassiday ..... A43B 21/28 36/29
2009/0151093 A1* 6/2009 Schindler ..... A61K 31/713 12/146 B
2009/0151196 A1* 6/2009 Schindler ..... A43B 13/12 36/29
2009/0178300 A1* 7/2009 Parker ..... A43B 13/188 36/29
2010/0170109 A1* 7/2010 Schindler ..... A43B 7/144 36/29
2010/0192409 A1* 8/2010 Schindler ..... A43B 21/28 36/35 B
2010/0236096 A1* 9/2010 Pauk ..... A43B 13/183 36/28
2010/0269376 A1* 10/2010 Flannery ..... A43B 13/181 36/30 R
2011/0185590 A1* 8/2011 Nishiwaki ..... A43B 13/181 36/28
2011/0197469 A1* 8/2011 Nishiwaki ..... A43B 13/186 36/28
2011/0232130 A1* 9/2011 Boudreau ..... A43B 13/181 36/88
2012/0102783 A1* 5/2012 Swigart ..... A43B 23/088 36/83
2012/0233885 A1* 9/2012 Shaffer ..... A43B 13/141 36/103
2013/0239443 A1* 9/2013 Lin ..... A43B 7/08 36/3 B
2014/0150298 A1* 6/2014 Crowley ..... A43B 7/148 36/103
2014/0202031 A1* 7/2014 Seo ..... A43B 13/16 36/28
2014/0259769 A1* 9/2014 Bjornson ..... A43B 13/14 36/91
2014/0259789 A1* 9/2014 Dojan ..... A43B 13/181 36/103
2014/0276500 A1* 9/2014 Scott ..... A61F 5/4404 604/343
2014/0331517 A1* 11/2014 Seo ..... A43B 7/1405 36/28
2015/0230549 A1* 8/2015 Bernhard ..... A43B 13/223 36/25 R
2016/0021974 A1* 1/2016 Schindler ..... A43B 13/223 12/146 B
2016/0192737 A1* 7/2016 Campos, II ..... A43B 13/223 36/28
2016/0331558 A1* 11/2016 Kampas ..... A61F 2/76
2017/0020228 A1* 1/2017 Scofield ..... A43B 13/184
2017/0095034 A1* 4/2017 Dupre ..... A43B 7/145
2017/0150778 A1* 6/2017 Youngs ..... A43B 13/188
2017/0273402 A1* 9/2017 Dupre ..... A43B 13/20

FOREIGN PATENT DOCUMENTS

CN 101547620 A 9/2009
CN 102258234 A 11/2011
CN 104273791 A 1/2015
CN 106793847 A 5/2017
TW I549618 B 9/2016
TW 201642772 A 12/2016

OTHER PUBLICATIONS

International Searching Authority, International Search Report and Written Opinion for PCT Application No. PCT/US2015/041489, mailed Oct. 15, 2015.
Taiwan Intellectual Property Office, Official Letter and Search Report for Application No. 105119165, mailed Mar. 3, 2017.
State Intellectual Property Office (PRC), Office Action for CN Application No. 201580046215.X, mailed Mar. 30, 2018.
Taiwan Intellectual Property Office, Office Action for TW Application No. 106134938, mailed Aug. 10, 2018.
State Intellectual Property Office (PRC), Second Office Action for CN Application No. 201580046215.X, mailed Dec. 25, 2018.
European Patent Office, Communication pursuant to Article 94(3) EPC for Application No. 15744838.2, mailed Feb. 22, 2019.
State Intellectual Property Office (PRC), Third Office Action for CN Application No. 201580046215.X, mailed May 15, 2019.
United States Patent and Trademark Office, Office Action for U.S. Appl. No. 15/622,397, mailed Jan. 29, 2019.
United States Patent and Trademark Office, Office Action for U.S. Appl. No. 15/622,397, mailed Jun. 6, 2019.
United States Patent and Trademark Office, Office Action for U.S. Appl. No. 14/340,374, mailed Aug. 5, 2016.
United States Patent and Trademark Office, Office Action for U.S. Appl. No. 14/340,374, mailed Jan. 29, 2016.
Taiwan Intellectual Property Office, Office Action for Application No. 109110672 , mailed Apr. 30, 2021.
European Patent Office, First Office Action for EP Application No. 20721018.8 mailed Jun. 21, 2022.
State Intellectual Property Office (PRC), First Office Action for CN App. No. 202080037167.9, mailed Oct. 25, 2022.

* cited by examiner

SOLE STRUCTURE OF AN ARTICLE OF FOOTWEAR

CROSS REFERENCE TO RELATED APPLICATION

This application claims priority to U.S. Provisional Application Ser. No. 62/825,339, filed Mar. 28, 2019, the disclosure of which is hereby incorporated by reference in its entirety.

FIELD

The present disclosure relates generally to sole structures for articles of footwear, and more particularly to sole structures incorporating a fluid-filled chamber.

BACKGROUND

This section provides background information related to the present disclosure which is not necessarily prior art.

Articles of footwear typically include an upper and a sole structure. The upper generally forms a footwear body that extends over a portion of a foot to retain the article of footwear on the foot and may extend over an instep and toe areas of the foot, along medial and lateral sides of the foot, and/or around a heel area of the foot. The upper may be formed from one or more material elements, such as textiles, polymer sheet layers, foam layers, leather, synthetic leather, and other materials. These materials may be attached together, such as by stitching or adhesive bonding. The upper may be configured to form an interior of the footwear that comfortably and securely receives a foot. An opening of the upper may facilitate entry and removal of a foot from the interior of the upper. A closure system, such as lacing, cinches, and/or straps may allow a wearer to adjust a fit of the article of footwear by selectively tightening and loosening the upper.

The sole structure is generally attached to the upper and disposed between a foot and a ground surface. For example, a sole structure may be attached to a lower portion of the upper. The sole structure may include one or more components, including one or more of an outsole, a midsole, an insole, an insert, and a bladder or a fluid-filled chamber, such as an airbag. The sole structure may also include other components or elements, such as ground surface traction elements, depending on the intended use of the article of footwear. Regardless of the particular construction of the sole structure, the sole structure may cooperate with the upper to provide a comfortable article of footwear configured to benefit a wearer engaged in any of a variety of activities.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
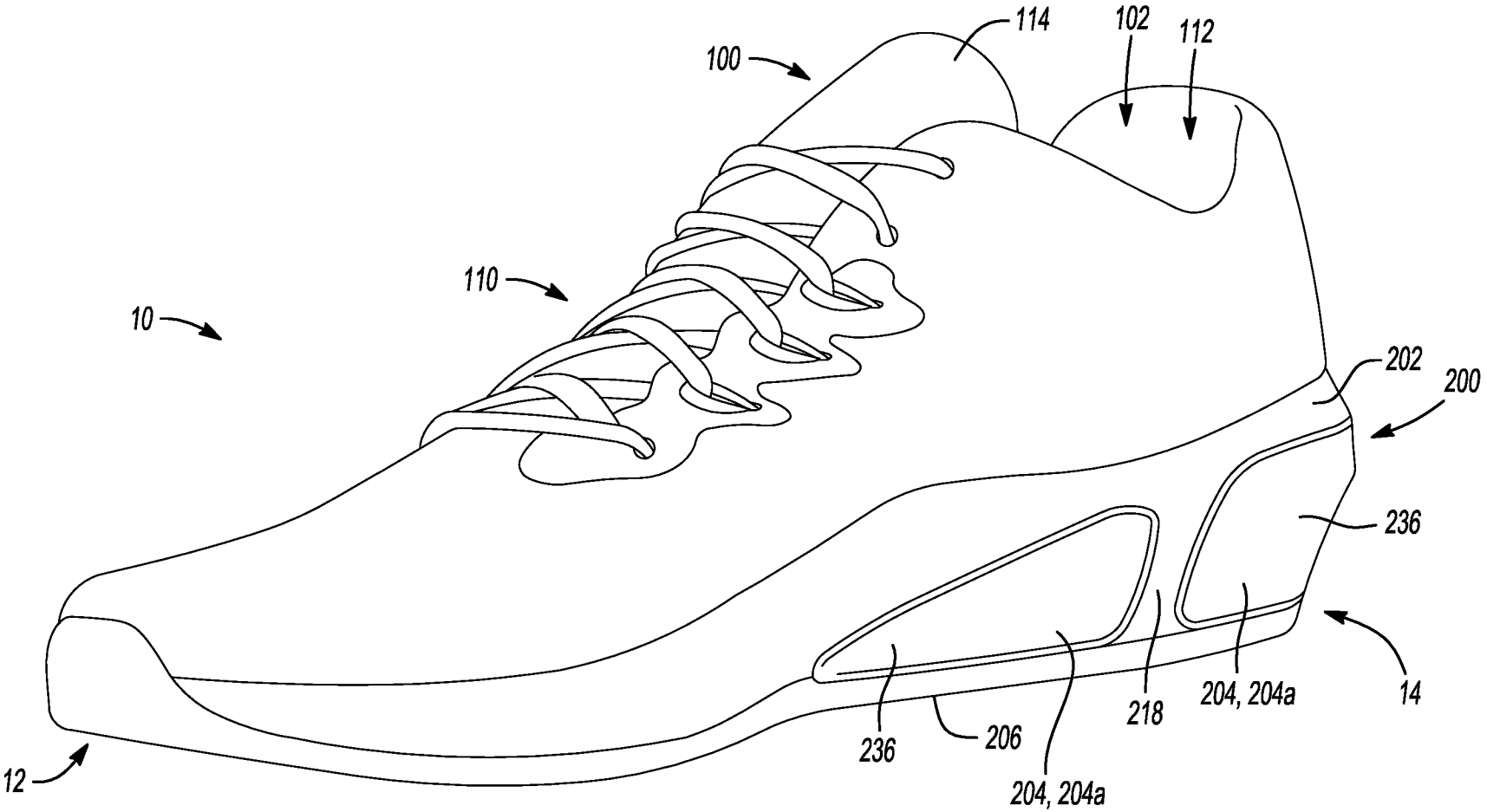
FIG. 1 is a perspective view of an article of footwear including an outsole component, a fluid-filled chamber component, and a midsole component having an inter-fitted configuration, in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure of an article of footwear. The sole structure includes a midsole having a plurality of projections, at least one of the plurality of projections forming a first portion of a peripheral side wall of the sole structure. The sole structure also includes a fluid-filled chamber having a central portion, a plurality of lobes extending outward from the central portion, and a plurality of channels formed between the plurality of lobes. A first lobe of the plurality of lobes is disposed between at least two of the plurality of projections such that the first lobe forms a second portion of the peripheral side wall of the sole structure.

Implementations of the disclosure may include one or more of the following optional features. In some implementations, the plurality of channels includes a first channel and a second channel. Here, the first lobe defines a first distance extending between the first channel and the second channel and a second distance extending from a bottom surface of the fluid-filled chamber to a top surface of the fluid-filled chamber, the first distance being substantially equal to the second distance.

In some examples, the midsole includes an upper surface and a lower surface opposite the upper surface, the plurality of projections being disposed within the plurality of channels from a top surface of the fluid-filled chamber to a bottom surface of the fluid-filled chamber. In this example, exposed side walls of the plurality of projections form the first portion of the peripheral side wall of the sole structure.

In some configurations, the plurality of lobes each define a distal end wall and the plurality of projections each define an exposed side wall, a plurality of the distal end walls and a plurality of the exposed side walls alternating in an inter-fitted configuration to form the peripheral side wall of the sole structure. The at least some of the distal end walls may be flush with at least some of the exposed side walls to form the peripheral side wall. The at least some of the distal end walls may be offset from at least some of the exposed side walls to form the peripheral side wall of the sole structure.

In some implementations, the sole structure includes an outsole having an exposed surface and a non-exposed surface opposite the exposed surface, where the fluid-filled chamber engages a first portion of the non-exposed surface, and the midsole engages a second portion of the non-exposed surface of the outsole. The outsole may include a lip disposed in a mid-foot region of the sole structure and configured to inhibit movement of the fluid-filled chamber toward a forefoot region of the sole structure. The outsole may include at least one protrusion disposed within at least one of the plurality of channels. Here, the midsole may engage the at least one protrusion.

In some examples, fluid-filled chamber includes a membrane defining a fluid-filled chamber and the midsole is non-hollow. The fluid-filled chamber may be tapered between a posterior end and an anterior end of the sole structure.

Another aspect of the disclosure provides a sole structure for an article of footwear. The sole structure includes a fluid-filled chamber having a central portion and a plurality of lobes extending outward from the central portion. The plurality of lobes form a first portion of a peripheral side wall of the sole structure. The sole structure also includes a midsole having a plurality of projections inter-fitted with the plurality of lobes and forming a second portion of the peripheral side wall of the sole structure.

Implementations of this aspect of the disclosure may include one or more of the following optional features. In some configurations, the plurality of lobes define a first channel and a second channel, a first lobe of the plurality of lobes defining a first distance extending between the first channel and the second channel and a second distance extending from a bottom surface of the fluid-filled chamber to a top surface of the fluid-filled chamber, the first distance being substantially equal to the second distance. The midsole may include an upper surface and a lower surface opposite the upper surface. Here, at least one of the plurality of projections may be disposed between two lobes of the plurality of lobes from the top surface to the bottom surface and exposed side walls of the plurality of projections may form the first portion of the peripheral side wall of the sole structure.

In some implementations, the plurality of lobes each define a distal end wall and the plurality of projections each define an exposed side wall, a plurality of the distal end walls and a plurality of the exposed side walls alternating in an inter-fitted configuration to form the peripheral side wall of the sole structure. The at least some of the distal end walls may be flush with at least some of the exposed side walls to form the peripheral side wall. The at least some of the distal end walls may be offset from at least some of the exposed side walls to form the peripheral side wall of the sole structure.

In some examples, the sole structure may include an outsole having an exposed surface and a non-exposed surface opposite the exposed surface, where the fluid-filled chamber engages a first portion of the non-exposed surface, and the midsole engages a second portion of the non-exposed surface of the outsole. The outsole may include a lip disposed in a mid-foot region of the sole structure and configured to inhibit movement of the fluid-filled chamber toward a forefoot region of the sole structure. Optionally, the outsole may include at least one protrusion disposed between at least two of the plurality of lobes. When the outsole includes at least one protrusion disposed between at least two of the plurality of lobes, the midsole may engage the at least one protrusion.

In some configurations, the fluid-filled chamber includes a membrane defining a fluid-filled chamber and the midsole is non-hollow. The fluid-filled chamber may also be tapered between a posterior end and an anterior end of the sole structure.

Another aspect of the disclosure provides a sole structure for an article of footwear, the sole structure including a midsole having a plurality of projections, at least one of the plurality of projections forming a first portion of a peripheral side wall of the sole structure. The sole structure further includes a fluid-filled chamber having a central portion, a plurality of lobes extending outward from the central portion and between respective projections of the plurality of projections to form a second portion of the peripheral side wall of the sole structure, a plurality of tunnels fluidly coupling respective lobes of the plurality of lobes to the central portion, and a plurality of channels defined by adjacent lobes of the plurality of lobes and adjacent tunnels of the plurality of tunnels, at least one channel of the plurality of channels having a different shape than an adjacent channel of the plurality of channels.

Implementations of this aspect of the disclosure may include one or more of the following optional features. In some configurations, the fluid-filled chamber may be asymmetric about a central, longitudinal axis of the fluid-filled chamber. Additionally or alternatively, the fluid-filled chamber may be asymmetric about a central axis extending between a medial side of the fluid-filled chamber and a lateral side of the fluid-filled chamber and substantially perpendicular to the longitudinal axis.

In one configuration, the plurality of lobes may include a first lobe, a second lobe, a third lobe, and a fourth lobe, at least two of the first lobe, the second lobe, the third lobe, and the fourth lobe including the same shape. In this configuration, the other two of the first lobe, the second lobe, the third lobe, and the fourth lobe (i) may include a different shape than the at least two of the first lobe, the second lobe, the third lobe, and the fourth lobe and (ii) may have the same shape as one another. The at least two of the first lobe, the second lobe, the third lobe, and the fourth lobe may be disposed on opposite sides of the fluid-filled chamber. Additionally or alternatively, the first lobe, the second lobe, the third lobe, and the fourth lobe may extend around a heel region of the sole structure.

Each tunnel of the plurality of tunnels may include approximately the same size and shape. An article of footwear may incorporate the sole structure described above.

Another aspect of the disclosure provides a sole structure for an article of footwear, the sole structure including a midsole having a plurality of projections, at least one of the plurality of projections forming a first portion of a peripheral side wall of the sole structure. The sole structure further includes a fluid-filled chamber having a central portion, a plurality of lobes extending outward from the central portion and between respective projections of the plurality of projections to form a second portion of the peripheral side wall of the sole structure, a plurality of tunnels fluidly coupling respective lobes of the plurality of lobes to the central portion, and a plurality of channels defined by adjacent lobes of the plurality of lobes and adjacent tunnels of the plurality of tunnels, the fluid-filled chamber being asymmetric about a central, longitudinal axis of the fluid-filled chamber.

Implementations of this aspect of the disclosure may include one or more of the following optional features. In some configurations, at least one channel of the plurality of channels may have a different shape than an adjacent channel of the plurality of channels.

In one configuration, the fluid-filled chamber may be asymmetric about a central axis extending between a medial side of the fluid-filled chamber and a lateral side of the fluid-filled chamber and substantially perpendicular to the longitudinal axis.

The plurality of lobes may include a first lobe, a second lobe, a third lobe, and a fourth lobe, at least two of the first lobe, the second lobe, the third lobe, and the fourth lobe including the same shape. In this configuration, the other two of the first lobe, the second lobe, the third lobe, and the fourth lobe (i) may include a different shape than the at least two of the first lobe, the second lobe, the third lobe, and the fourth lobe and (ii) may have the same shape as one another. The at least two of the first lobe, the second lobe, the third lobe, and the fourth lobe may be disposed on opposite sides of the fluid-filled chamber. Additionally or alternatively, the first lobe, the second lobe, the third lobe, and the fourth lobe may extend around a heel region of the sole structure.

Each tunnel of the plurality of tunnels may include approximately the same size and shape. An article of footwear may incorporate the sole structure described above.

Figure 2:
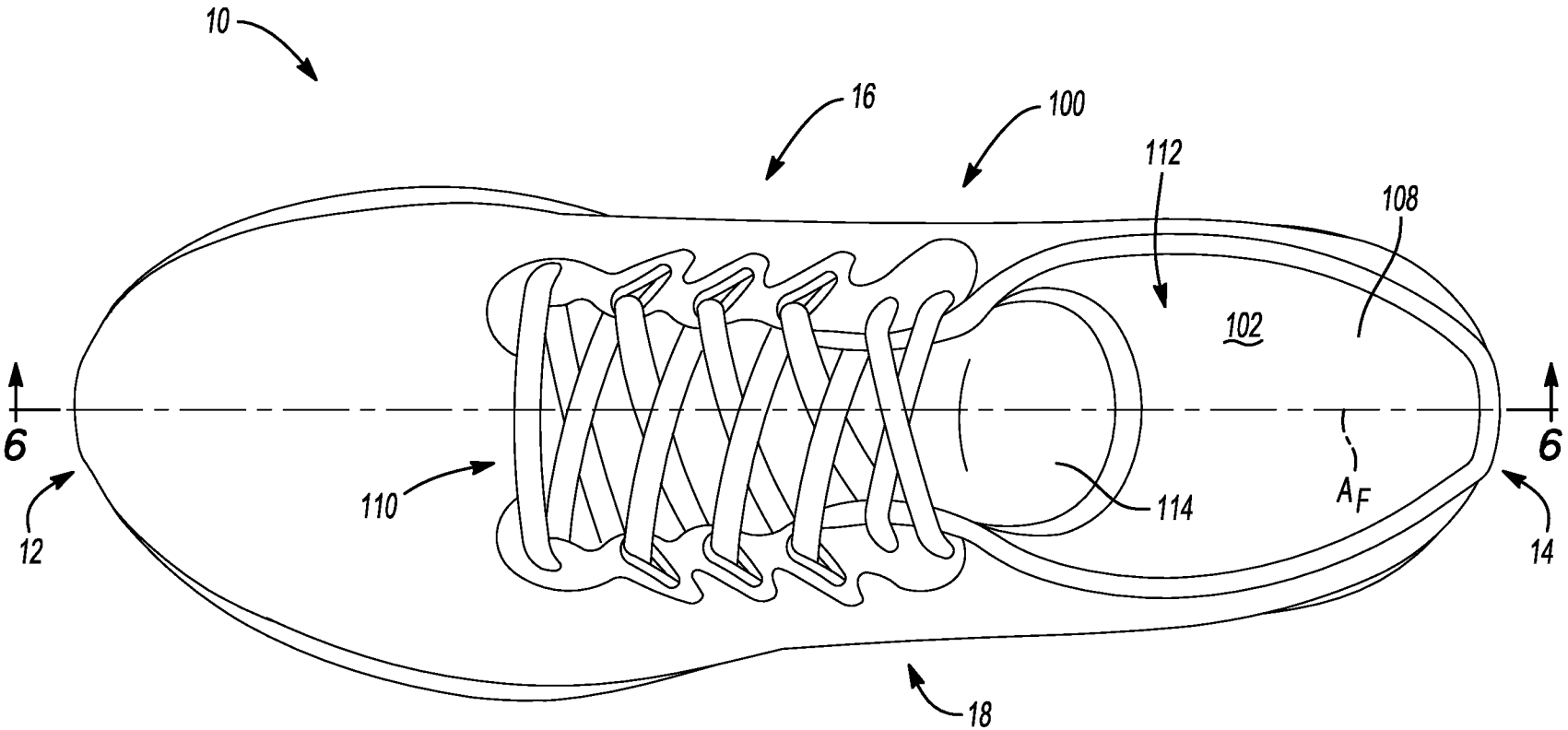
FIG. 2 is a top view of the article of footwear of FIG. 1.
Figure 3:
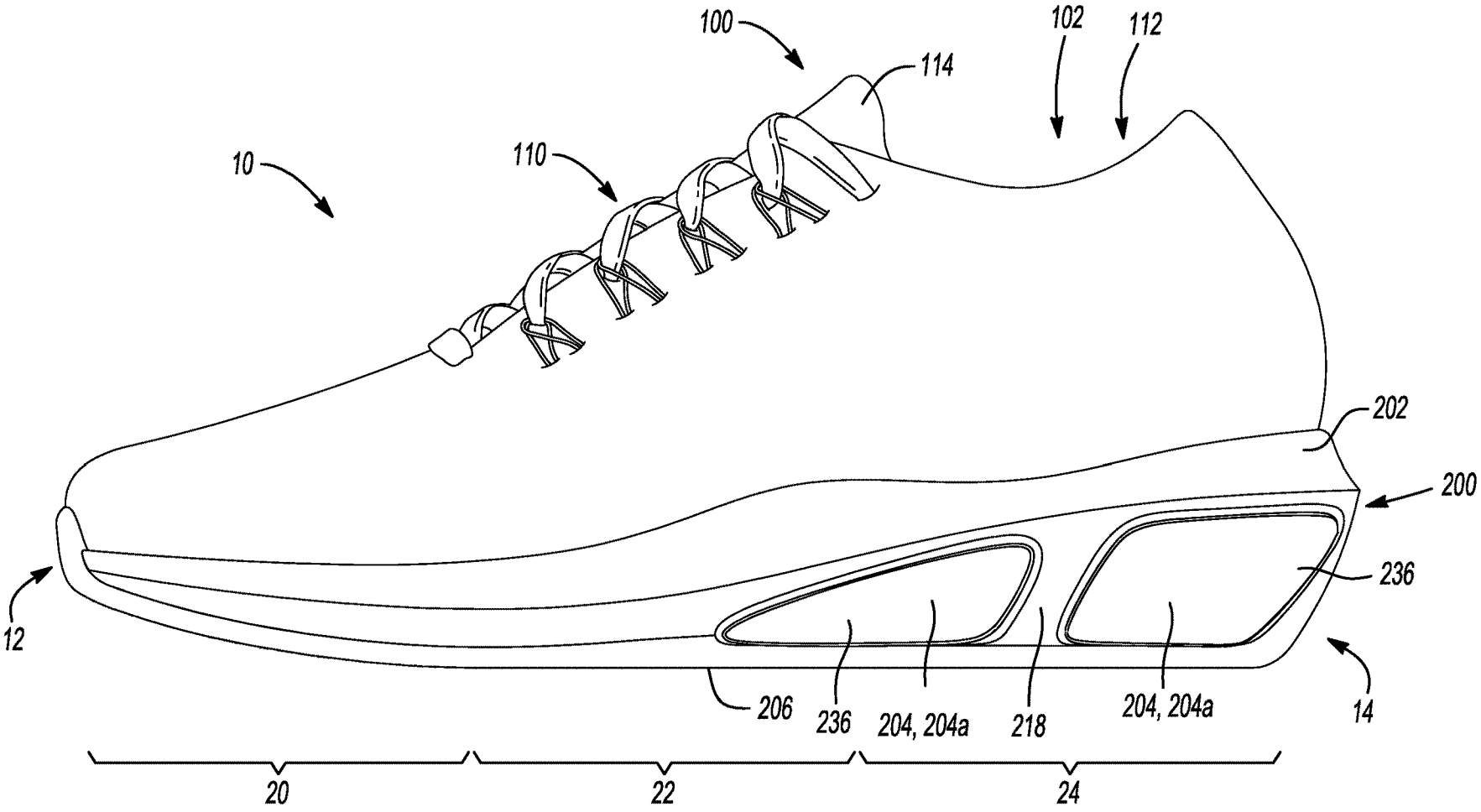
FIG. 3 is a side view of the article of footwear of FIG. 1.

Referring to FIGS. 1-3, an article of footwear 10 includes an upper 100 and a sole structure 200. The footwear 10 may further include an anterior end 12 associated with a forward-most point of the footwear, and a posterior end 14 corresponding to a rearward-most point of the footwear 10. As shown in FIG. 2, a longitudinal axis $A_F$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18. The article of footwear 10 may be divided into one or more regions. The regions may include a forefoot region 20, a mid-foot region 22, and a heel region 24. The mid-foot region 22 may correspond with an arch area of the foot, and the heel region 24 may correspond with rear portions of the foot, including a calcaneus bone.

The upper 100 includes interior surfaces that define an interior void 102 operable to receive and secure a foot for support on the sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort.

Figure 4:
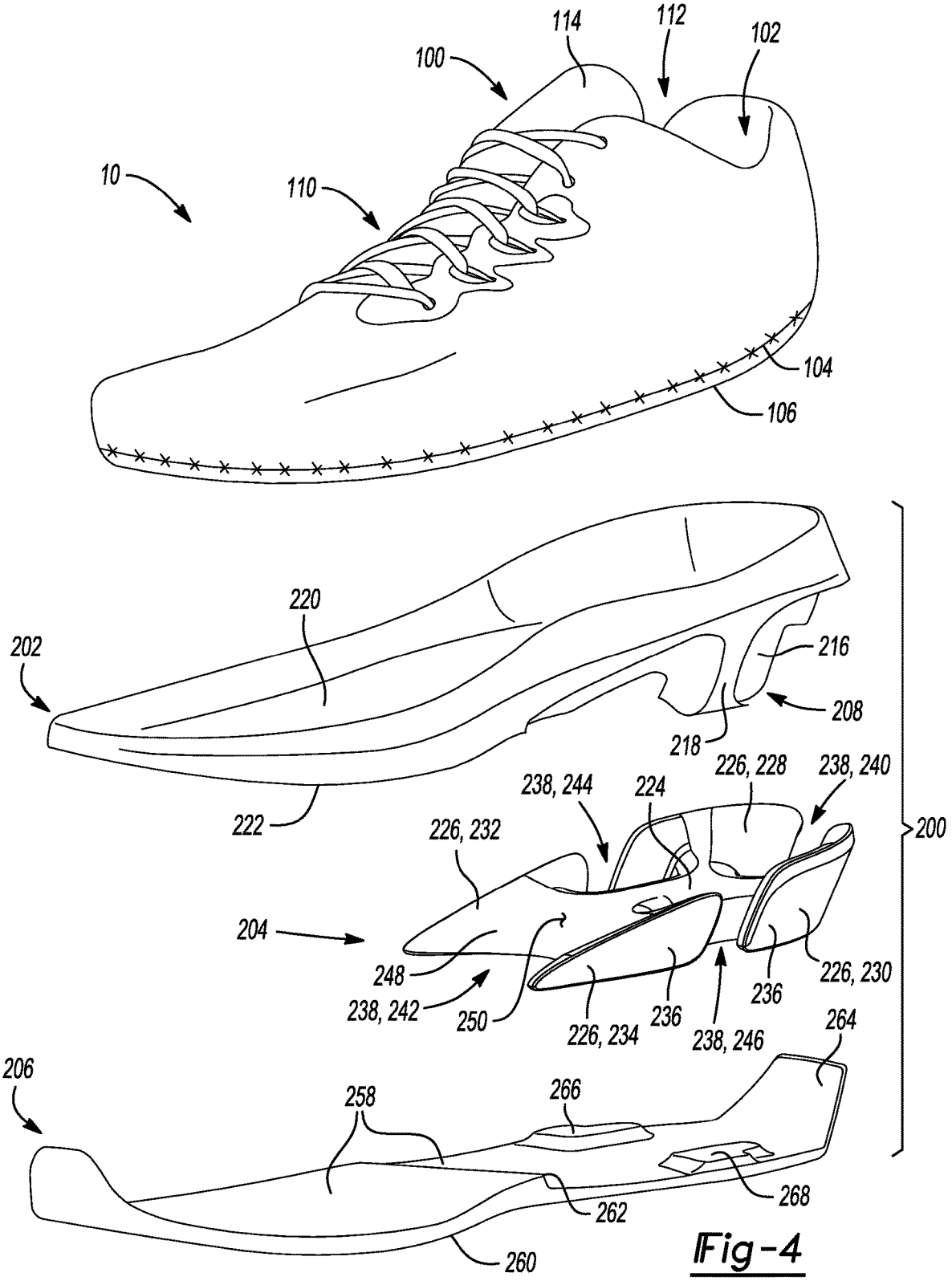
FIG. 4 is an exploded view from a top perspective of the article of footwear of FIG. 1.

With reference to FIG. 4, in some examples, the upper 100 includes a strobel 104 having a bottom surface opposing the sole structure 200 and an opposing top surface defining a footbed 106 of the interior void 102. Stitching or adhesives may secure the strobel 104 to the upper 100. The footbed 106 may be contoured to conform to a profile of the bottom surface (e.g., plantar) of the foot. Optionally, the upper 100 may also incorporate additional layers such as an insole 108 or sockliner that may be disposed upon the strobel 104 and reside within the interior void 102 of the upper 100 to receive a plantar surface of the foot to enhance the comfort of the article of footwear 10. An ankle opening 112 in the heel region 24 may provide access to the interior void 102. For example, the ankle opening 112 may receive a foot to secure the foot within the interior void 102 and to facilitate entry and removal of the foot to and from the interior void 102.

In some examples, one or more fasteners 110 extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners 110. The fasteners 110 may include laces, straps, cords, hook-and-loop, or any other suitable type of fastener. The upper 100 may include a tongue portion 114 that extends between the interior void 102 and the fasteners.

The sole structure 200 may include a midsole component 202, a fluid-filled chamber component 204, and an outsole component 206. The sole structure 200 may be secured to a lower surface of upper 100, such as by stitching or adhesive bonding. The fluid-filled chamber component 204 may be attached to the midsole component 202, such as by adhesive bonding, and the outsole component 206 may be secured to the midsole component 202 or the fluid-filled chamber component 204, such as by adhesive bonding. Those skilled in the art will appreciate alternative materials for, and methods suitable for attaching, the upper 100, the midsole component 202, the fluid-filled chamber component 204, and the outsole component 206.

The sole structure 200 generally operates to attenuate impact and other ground reaction forces and absorb energy as, for example, the sole structure 200 contacts a ground surface during active use. As shown in FIG. 1, in some implementations, the midsole component 202 is located adjacent a foot when the foot is disposed in an interior of the upper 100. In some implementations, the midsole component 202 generally conforms to contours of the foot and provides the foot with cushioning during walking, running, or other activities.

In some implementations, as discussed below, the midsole component 202 and the fluid-filled chamber component 204 inter-fit with the outsole component 206 to form an assembled sole structure 200, as shown in FIGS. 1-3. For example, the midsole component 202, the fluid-filled chamber component 204, and the outsole component 206 may be inter-fitted with one another during a manufacturing process to form the assembled sole structure 200. In particular, the fluid-filled chamber component 204 and the outsole component 206 may be manufactured separately and laid up in a mold cavity of a molding system for molding a sole structure, and the inter-fitted midsole component 202 may be formed by injection molding a molding material, such as a polymer foam material, into the mold cavity of the molding system, including the laid-up sole component(s), to achieve a sole structure 200 having an inter-fitted configuration. In some implementations, the midsole component 202, the fluid-filled chamber component 204, and the outsole component 206 are manufactured separately, such as by various molding processes using separate molding systems and mold materials, and then bonded together in an inter-fitted configuration to form the assembled sole structure 200.

Figure 5:
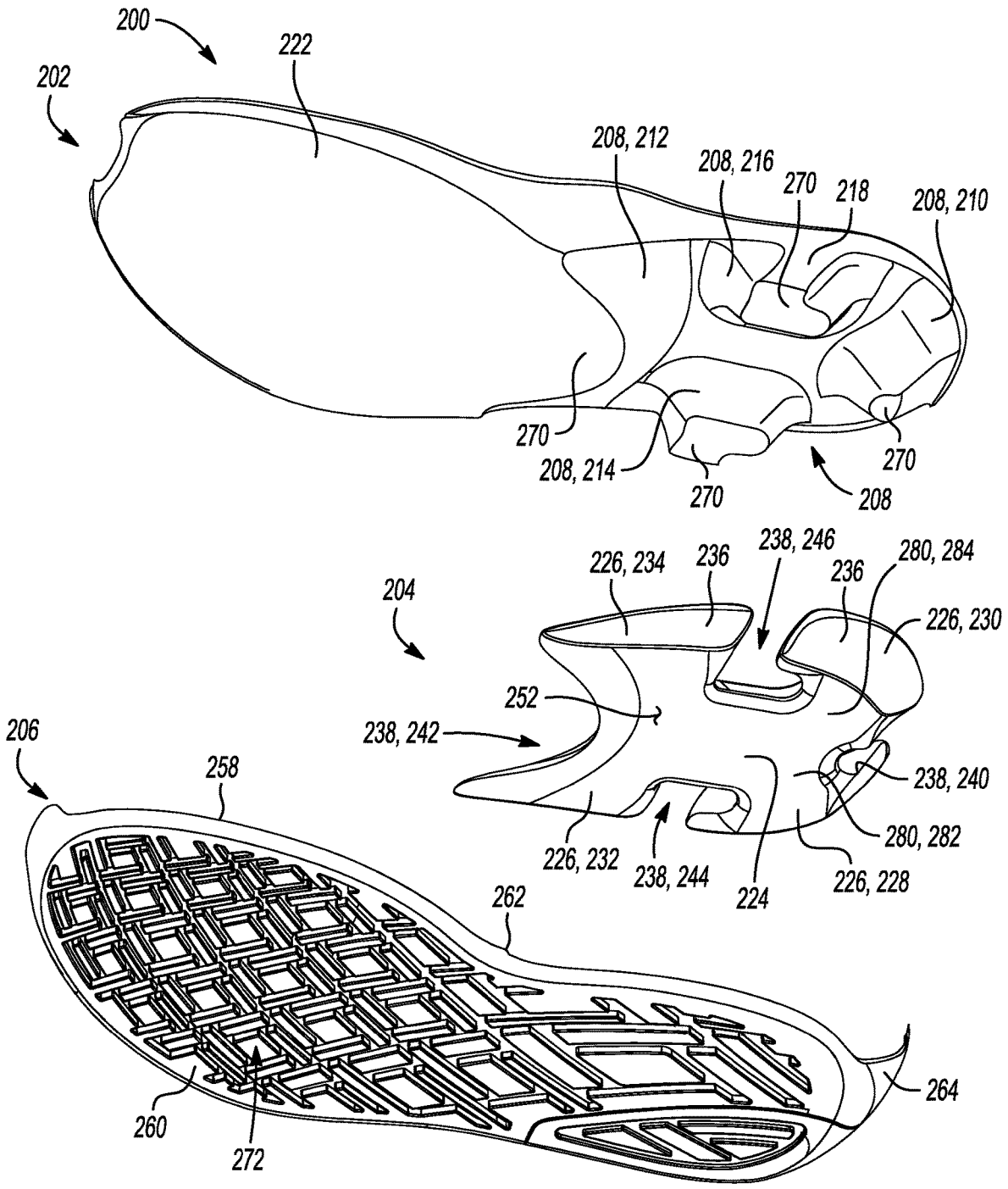
FIG. 5 is an exploded view from a bottom perspective of a sole structure of the article of footwear of FIG. 1.

The midsole component 202 may include at least one midsole component or element. As shown in FIGS. 4 and 5, in some implementations, the midsole component 202 includes a single midsole component or element. In some implementations, the midsole component 202 is substantially solid or non-hollow. In some implementations, the midsole component 202 is formed of a foam material, such as a polymer foam material having an open or closed cell foam structure. The foam material may beneficially compress resiliently under an applied load. In some implementations, the midsole component 202 is formed of a material that is mold compatible or otherwise suitable for bonding with the fluid-filled chamber component 204 and/or the outsole component 206, such as by adhesive or thermal bonding. As further discussed below, the midsole component 202 may include a plurality of projections 208, such as a rear projection 210, a front projection 212, a medial projection 214, and a lateral projection 216, that may be inserted through and inter-fitted with structures of the fluid-filled the chamber component 204 and/or the outsole component 206. In some implementations, at least some of the plurality of projections 208, 210, 212, 214, 216 are provided with outer (e.g., peripheral) side walls 218. As will be described below, in the assembled configuration, the outer side walls 218 may be exposed within the fluid-filled chamber component 204 to define at least a portion of a peripheral side wall of the sole structure 200.

Figure 6:
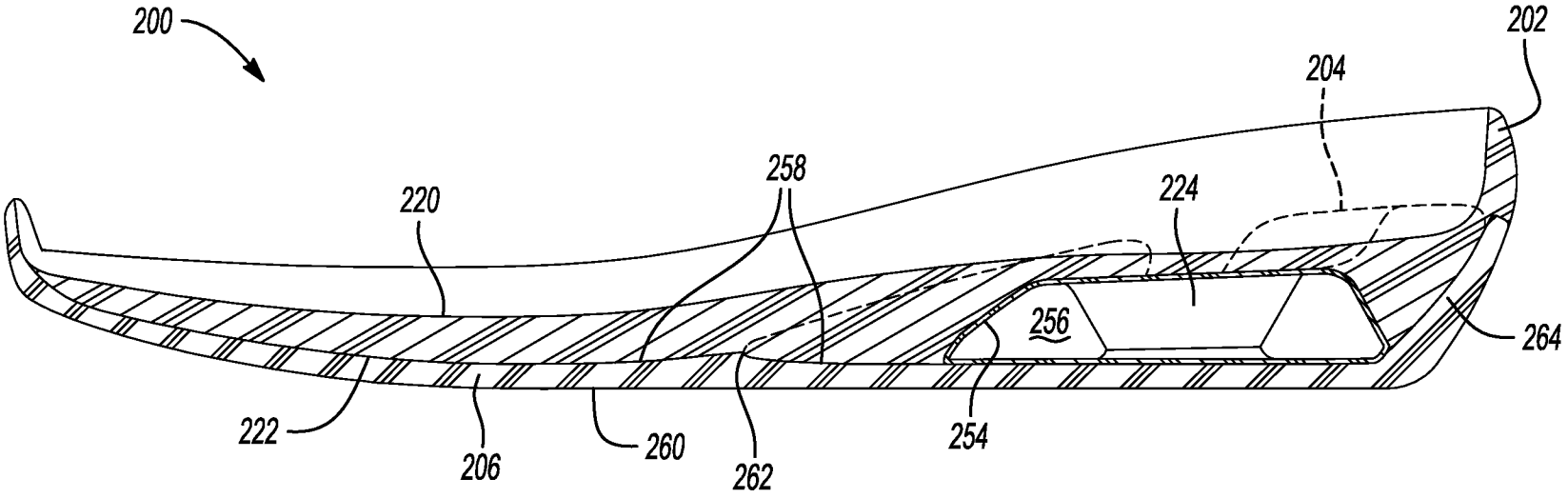
FIG. 6 is a cross-sectional view of the sole structure of FIG. 5 taken along line 6-6 of FIG. 2.

With reference to FIGS. 5 and 6, the midsole component 202 generally has a top or upper surface 220, a bottom or lower surface 222 opposite the upper surface 220, and the plurality of projections 208, 210, 212, 214, 216 that extend away from (e.g., downward) the lower surface 222. The upper surface 220 may have a smooth finish that follows contours of a foot and provides a comfortable fit. The projections 208, 210, 212, 214, 216 generally are wider nearer to a central portion (e.g., nearer the axis $A_F$) of the midsole component 202 than at the side walls 218. For example, a distal end (e.g., offset from the lower surface 222) of the projections 208, 210, 212, 214, 216 may be wider nearer the axis $A_F$ of the midsole component 202 than at the side walls 218.

Example resilient polymeric materials for the midsole component 202 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some implementations, the foamed polymeric material is a crosslinked foamed material. In these implementations, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

As shown in FIGS. 1, 4, and 5, in some implementations, the fluid-filled chamber component 204 generally is disposed between the midsole component 202 and the outsole component 206. The fluid-filled chamber component 204 may be made of any material suitable for holding a desired fluid in a sealed manner within a sole construction. In some implementations, the fluid-filled chamber component 204 is made of a polymer material that is substantially impermeable to fluid. For example, in some implementations, the fluid-filled chamber component 204 is made of a thermoplastic elastomer.

The fluid-filled chamber component 204 may be manufactured using a variety of techniques. For example, the fluid-filled chamber component 204 may be made by blow molding, thermoforming, rotational molding, or other molding processes. As shown in FIG. 1, in some implementations, the midsole component 202 is inter-fitted with the fluid-filled chamber component 204 in a manner that presents the sole structure 200 and the article of footwear 10 having an aesthetically pleasing side profile.

The fluid-filled chamber component 204 may include one or more fluid-filled chamber components or elements. In some implementations, multiple fluid-filled chamber components or elements having different characteristics, e.g., having different sizes, configurations, volumes, fluids, pressures, or other compression or performance characteristics, are provided in respective impact zones of the article of footwear 10. Alternatively, there may be a single fluid-filled chamber component or element. Such configurations may enable customization of compression characteristics of the fluid-filled chamber component(s) and associated performance characteristics of the sole structure 200 and the article of footwear 10.

As shown in FIGS. 4 and 5, in some implementations, the fluid filled chamber component 204 is located in the heel region 24 of the article of footwear 10. In this regard, the fluid-filled chamber component 204 may provide inflation and performance characteristics suitable for attenuating impact and ground reaction forces associated with the heel region 24 of the article of footwear 10, such as a heel strike portion of a running stride. Those skilled in the art will be able to select a number, configuration, and arrangement of fluid-filled chamber component(s) suitable for desired performance characteristics of a sole structure in view of the present disclosure.

With reference to FIGS. 7A-7F, the fluid-filled chamber component 204 may include a central portion 224 and a plurality of lobes 226 extending outward from the central portion 224. The plurality of lobes 226 may include a rear medial lobe 228, a rear lateral lobe 230, a front medial lobe 232, and a front lateral lobe 234. Each of the lobes 226, 228, 230, 232, 234 may include a distal end wall 236 disposed at a peripheral side surface of the sole structure 200 in the assembled configuration. Each of the lobes 226, 228, 230, 232, 234 may generally be wider near the distal end walls 236 than near the central portion 224. In particular, each of the lobes 226, 228, 230, 232, 234 may be widest at the distal end walls 236. In some implementations, each of the distal end walls 236 are exposed to form a portion of the peripheral side surface of the sole structure 200 in the assembled configuration, while the outer side walls 218 may be exposed within the fluid-filled chamber component 204 to define at least another portion of a peripheral side wall of the sole structure 200, as previously described. For example, one or more of the outer side walls 218 may be substantially flush (e.g., coplanar) with one or more of the distal end walls 236 such that the peripheral side wall of the sole structure defines a smooth outer surface. Alternatively, one or more of the outer side walls 218 may be offset (e.g., stepped) from one or more of the distal end walls 236 such that the peripheral side wall of the sole structure defines a stepped outer surface.

Figure 7A:
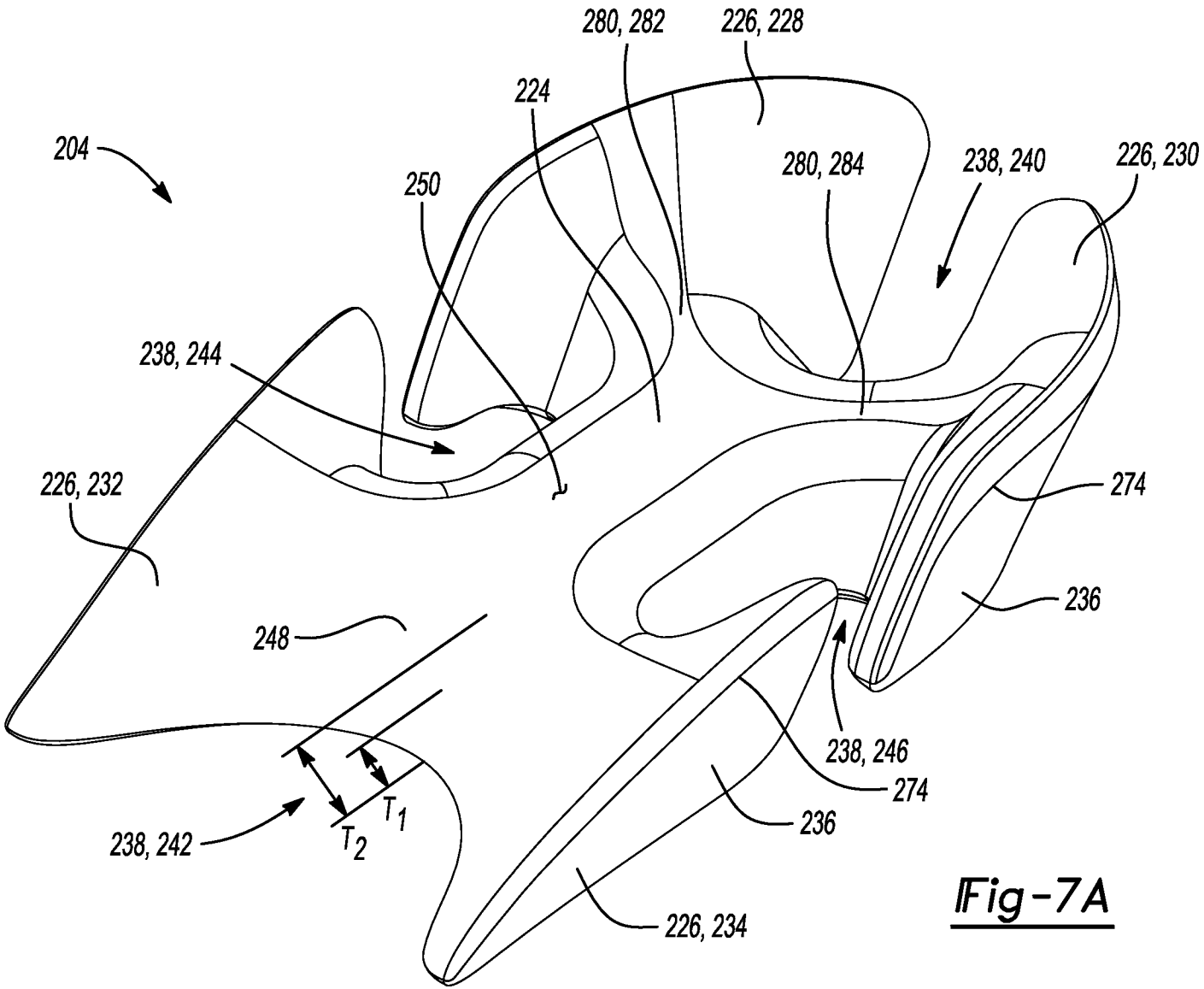
FIG. 7A is a top perspective view of a fluid-filled chamber component of the article of footwear of FIG. 1.
Figure 7B:
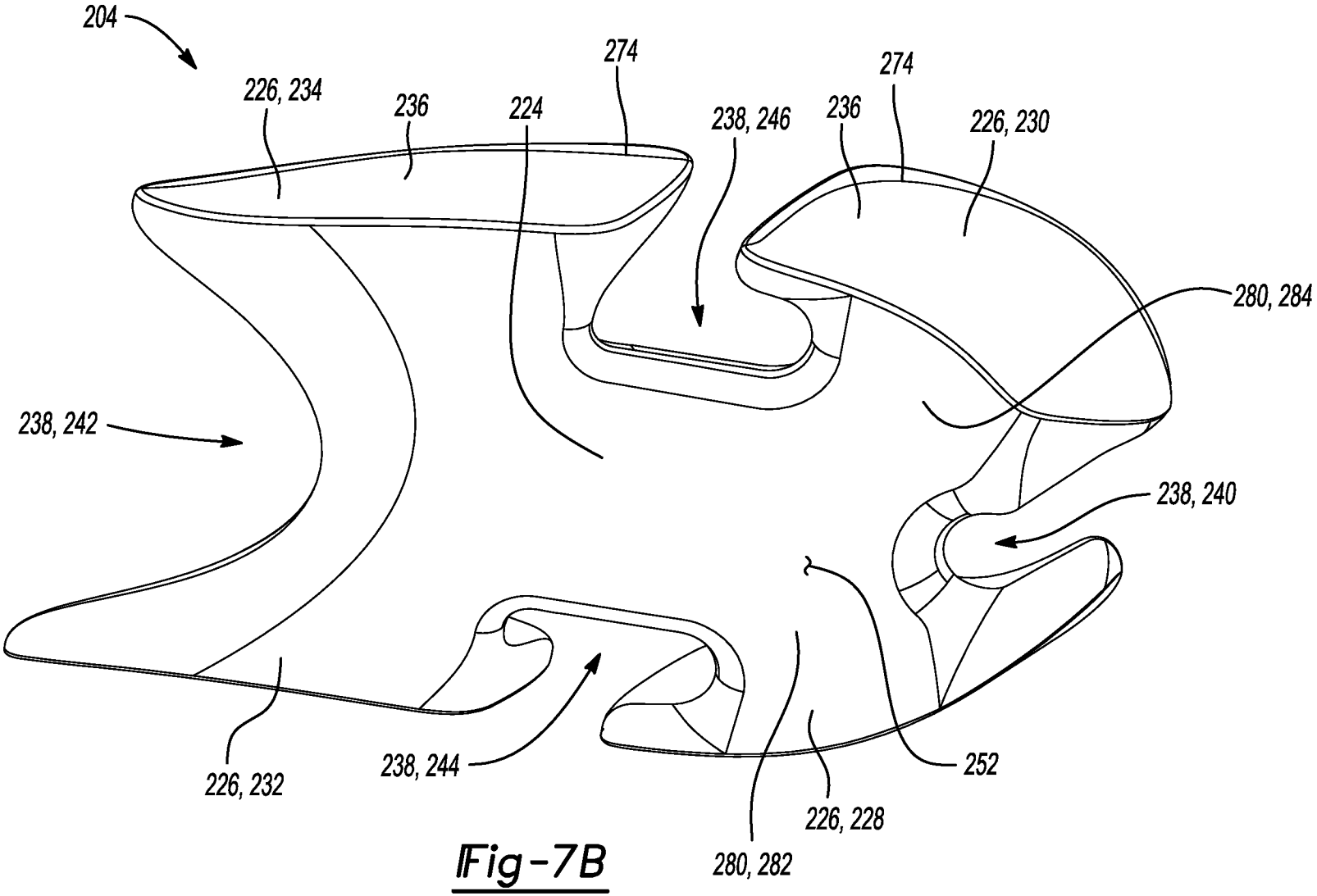
FIG. 7B is a bottom perspective view of the fluid-filled chamber component of FIG. 7A.
Figure 7C:
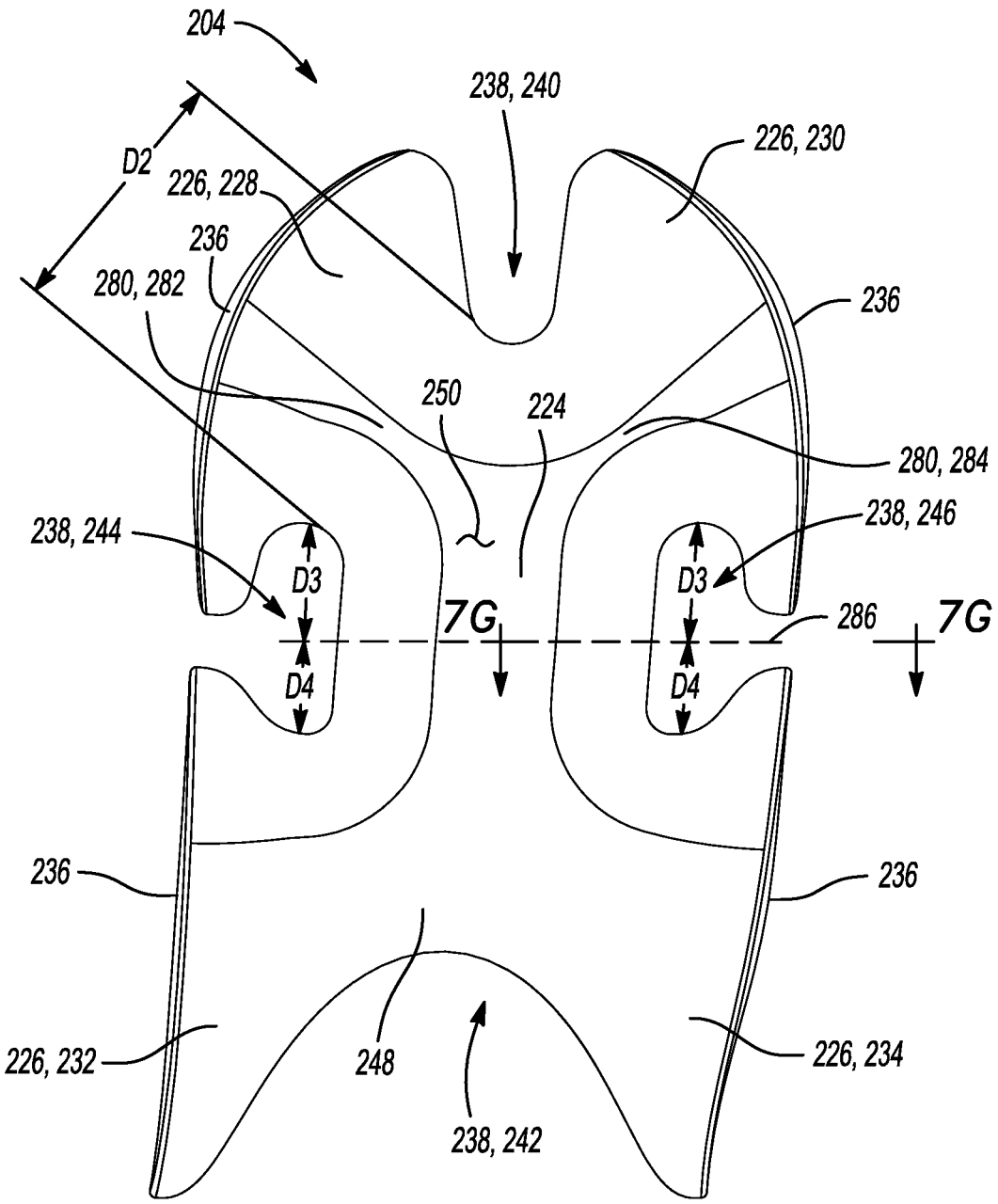
FIG. 7C is a plan view of a top of the fluid-filled chamber component of FIG. 7A.
Figure 7D:
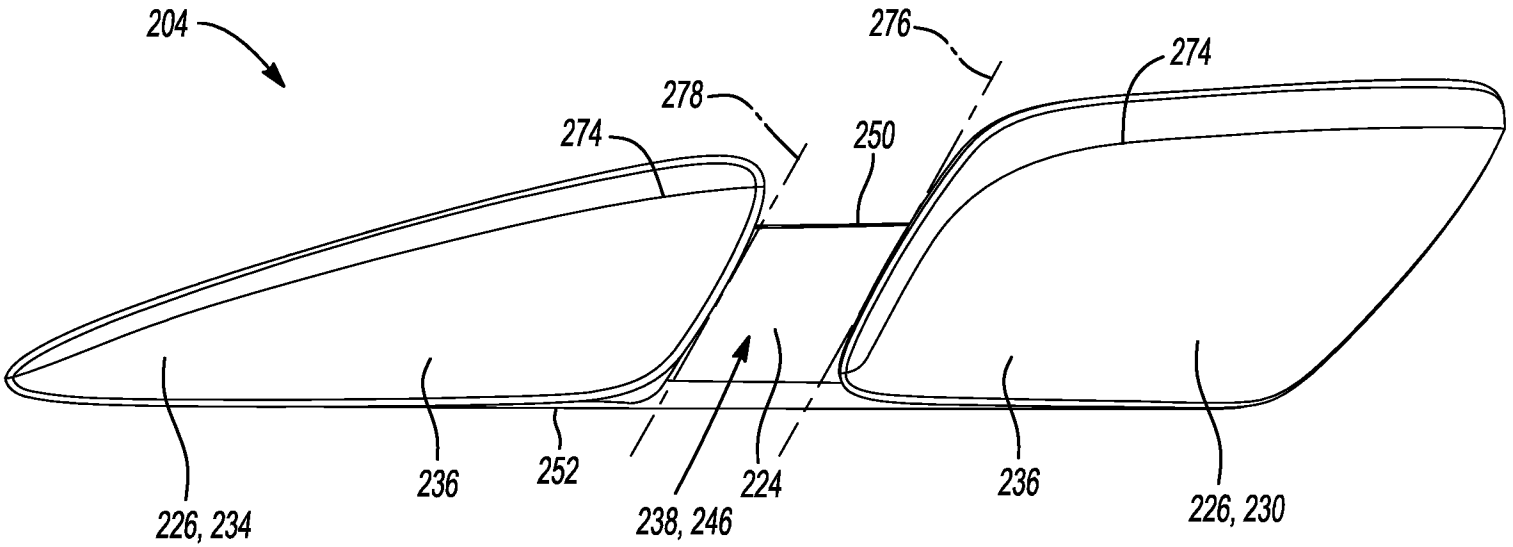
FIG. 7D is a plan view of a side of the fluid-filled chamber component of FIG. 7A.
Figure 7E:
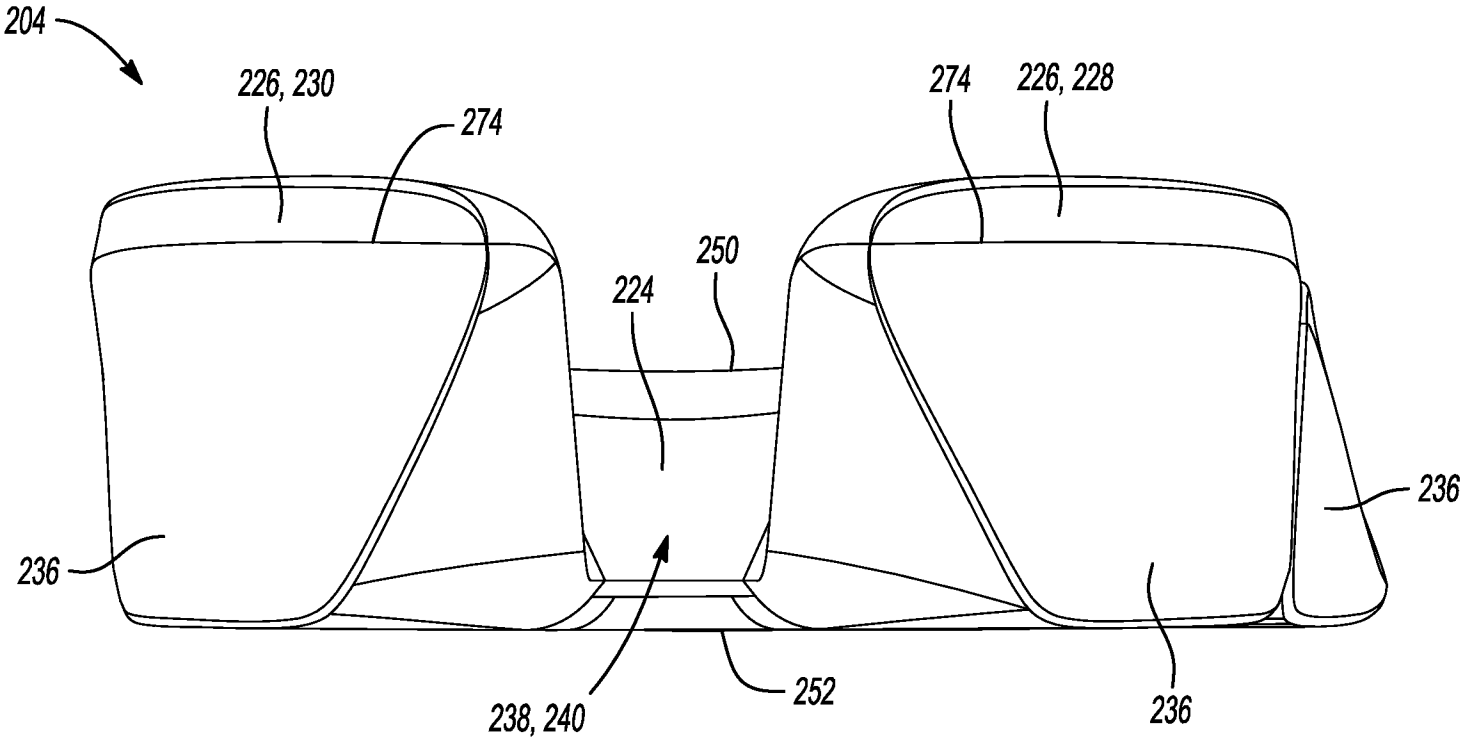
FIG. 7E is a plan view of a rear of the fluid-filled chamber component of FIG. 7A.

As illustrated in FIG. 7D, in some implementations, the distal end wall 236 of the rear lateral lobe 230 or the rear medial lobe 228 defines a substantially rhomboidal shape, while the distal end wall of the front lateral lobe 234 or the front medial lobe 232 defines a substantially triangular shape. In this regard, a portion of the rear medial or lateral lobe 228, 230 may define a rear longitudinal axis 276 along the peripheral side surface and a portion of the front lateral lobe 234 may define a front longitudinal axis 278 along the peripheral side surface. The rear longitudinal axis 276 may be substantially parallel to the front longitudinal axis 278. As another example, the rear longitudinal axis 276 may have any suitable relationship relative to the front longitudinal axis 278. A similar relationship may be formed between the rear medial lobe 228 and the front medial lobe 232.

In some implementations, the fluid-filled chamber component 204 includes a plurality of tunnels 280 extending between the central portion 224 and the plurality of lobes 226. The tunnels 280 may provide lateral and sagittal shear stability to the fluid-filled chamber component 204, provide structure to the peripheral side surface of the sole structure 200 in the assembled configuration, and reduce excessive displacement and collapse. In some implementations, the plurality of tunnels 280 include a rear medial tunnel 282 extending from the central portion 224 to the rear medial lobe 228 and a rear lateral tunnel 284 extending from the central portion 224 to the rear lateral lobe 230.

Figure 7F:
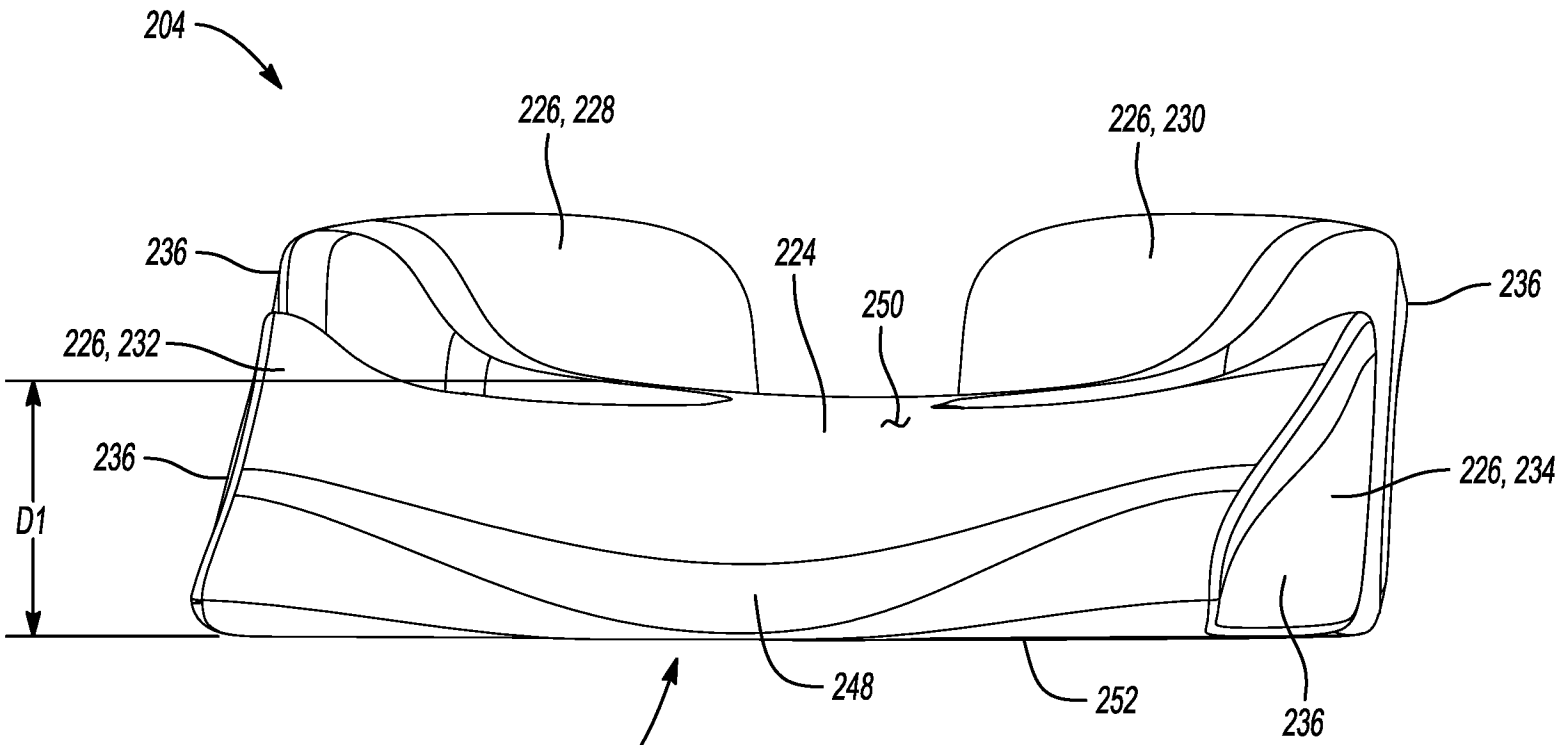
FIG. 7F is a plan view of a front of the fluid-filled chamber component of FIG. 7A.
Figure 7G:
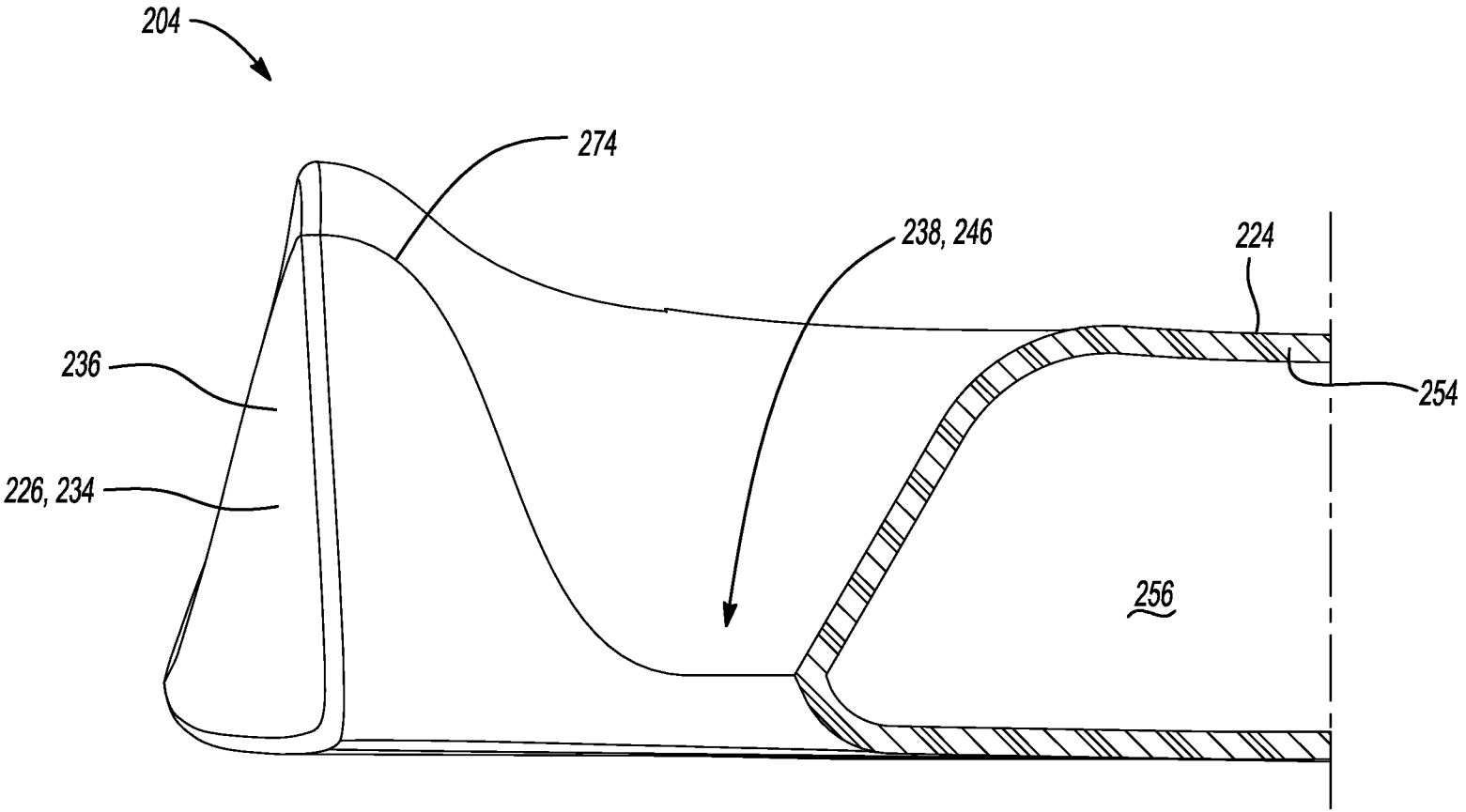
FIG. 7G is a cross-sectional view of the fluid-filled chamber component of FIG. 7A taken along line 7G-7G of FIG. 7C.

With reference to FIGS. 7C and 7F, the tunnels 280 define a first distance D1, also referred to as a height, and a second distance D2, also referred to as a width. The first distance D1 may extend from a top surface 250 of the fluid-filled chamber component 204 (e.g., the top surface 250 proximate the tunnel 280) to a bottom surface 252 of the fluid-filled chamber component 204 (e.g., the bottom surface 250 proximate the tunnel 280). In some implementations, the first distance D1 extends at a substantially right angle relative to one or both of the top surface 250 or the bottom surface 252. As shown in FIG. 7C, the second distance D2 may extend along the top surface 250 or the bottom surface 252 from the rear channel 240 (e.g., an edge of the fluid-filled chamber component 204 defining the rear channel 240) to the medial channel 244 (e.g., an edge of the fluid-filled chamber component 204 defining the medial channel 244) or to the lateral channel 246 (e.g., an edge of the fluid-filled chamber component 204 defining the lateral channel 246). The second distance D2 may be twice as large as the first distance D1. Alternatively, the first distance D1 may be equal to the second distance D2. As another example, the first distance D1 and the second distance D2 may have any suitable relationship with each other. In some implementations, a ratio of the second distance D2 to the first distance D1 varies in a direction extending along the second distance D2. For example, a value of the first distance D1 may increase or decrease as measured along the distance D2, such that the ratio of the second distance D2 to the first distance D1 increases or decreases between 2:1 and 1:1.

The fluid-filled chamber component 204 may further include a plurality of channels 238. In some implementations, the channels 238 include a rear channel 240, a front channel 242, a medial channel 244, and a lateral channel 246. Each channel 240, 242, 244, 246 may be disposed between two different adjacent lobes of the plurality of lobes 228, 230, 232, 234. In this regard, any two of the lobes 228, 230, 232, 234 of the plurality of lobes 226 may define one of the channels 240, 242, 244, 246 of the plurality of channels 238. For example, the rear medial lobe 228 and the rear lateral lobe 230 may define the rear channel 240, the front medial lobe 232 and the front lateral lobe 234 may define the front channel 242, the rear medial lobe 228 and the front medial lobe 232 may define the medial channel 244, and the rear lateral lobe 230 and the front lateral lobe 234 may define the lateral channel 246. As previously described, in some implementations, the rear longitudinal axis 276 and the front longitudinal axis 278 are defined by portions of the peripheral side surface of the lobes 228, 230, 232, 234 such that the rear longitudinal axis 276 is substantially parallel to the front longitudinal axis 278. In this regard, as illustrated in FIG. 7D, in some implementations, the front and rear longitudinal axes 276, 278 are disposed along opposed portions of the peripheral side surface of the lobes 228, 230, 232, 234 such that the front and rear longitudinal axes 276, 278 are disposed at non-orthogonal angles relative to the bottom surface 252.

With reference to FIG. 7C, the medial channel 244 may define a distance from the rear medial lobe 228 to the front medial lobe 232 equal to the sum of a third distance D3 and a fourth distance D4. Similarly, the lateral channel 246 may include a distance from the rear lateral lobe 230 to the front lateral lobe 234 equal to the sum of the third distance D3 and the fourth distance D4. The third distance D3 may extend from the rear medial lobe 228 or the rear lateral lobe 230 to a midpoint 286 between the rear medial lobe 228 and the front medial lobe 232 or between the rear lateral lobe 230 and the front lateral lobe 234 along the peripheral side surface. The fourth distance D4 may extend from the front medial lobe 232 or the front lateral lobe 230 to the midpoint 286. In some implementations, the third distance D3 is equal to the fourth distance D4, such that the medial channel 244 and the lateral channel 246 are substantially symmetrical relative to the midpoint 286. In other implementations, the third distance D3 is not equal to the fourth distance D4, such that the medial channel 244 and the lateral channel 246 are substantially asymmetrical relative to the midpoint 286. For example, the third distance D3 may be greater than the fourth distance D4. The third distance D3 and the fourth distance D4 may each be modified by modifying a size of at least one of the lobes 226 or the tunnels 280.

The fluid-filled chamber component 204 may include a wedge portion 248 disposed between the front medial lobe 232 and the front lateral lobe 234. For example, the wedge portion 248 may be formed as a component of the front medial lobe 232 and the front lateral lobe 234. Alternatively, the wedge portion 248 may be a component separate from the front medial lobe 232 and the front lateral lobe 234. The wedge portion 248 may taper outward from the central portion 224. For example, as illustrated in FIG. 7A, the wedge portion 248 may have a first thickness T1 at a first location and a second thickness T2 at a second location closer to the posterior end 14 than the first location, the first thickness T1 being less than the second thickness T2. In some implementations, the wedge portion 248 defines a constant taper in a direction extending toward the anterior end 12 from the central portion 224.

The fluid-filled chamber component 204 may include a top surface 250 and the bottom surface 252. The top surface 250 may generally face the bottom surface 222 of the midsole component 202, and the bottom surface 252 may generally face a top surface 258 of the outsole component 206. At least a portion of the top surface 250 may be concave. In an assembled configuration, as shown in FIGS. 1-3, the top surface 250 may contact the bottom surface 222 of the midsole component 202, and the bottom surface 252 may contact the top surface 258 of the outsole component 206. In some implementations, the taper of the wedge portion 248 is defined by the top surface 250 converging toward the bottom surface 252 in the direction extending toward the anterior end 12 from the central portion 224. In some implementations, one or more of the plurality of channels 238 extend continuously through an entire thickness of the fluid-filled chamber component 204 from the top surface 250 to the bottom surface 252.

With reference to FIG. 6, the fluid-filled chamber component 204 may include a membrane 254 that defines a fluid-filled chamber 256 of the fluid-filled chamber component 204. There may be any suitable number of chambers 256. For example, there may be a single chamber as shown in FIG. 6. Alternatively, there may be a plurality of chambers each defining a discrete component of the fluid-filled chamber component 204. For example, there may be a discrete chamber for one or more (e.g., all) of the central portion 224, the rear medial lobe 228, the rear lateral lobe 230, the front medial lobe 232, and the front lateral lobe 234. In other implementations, one or more of the central portion 224, the rear medial lobe 228, the rear lateral lobe 230, the front medial lobe 232, or the front lateral lobe 234 collectively define a single chamber.

In some implementations, the membrane 254 is produced (e.g., thermoformed or blow molded) from a monolayer film (e.g., a single layer). In other implementations, the membrane 254 is produced (e.g., thermoformed or blow molded) from a multilayer film (e.g., multiple sublayers). In either aspect, the membrane 254 can have a film thickness ranging from about 0.2 micrometers to about be about 1 millimeter. In further implementations, the film thickness for the membrane 254 can range from about 0.5 micrometers to about 500 micrometers. In yet further implementations, the film thickness for the membrane 254 can range from about 1 micrometer to about 100 micrometers.

As illustrated in FIGS. 7A-7G, in some implementations, formation of the membrane 254 and the chamber 256 forms a parting line 274 of the fluid-filled chamber component 204. The parting line 274 may define an edge where a perimeter of a cavity and a core of an extrusion blow mold meet during a blow molding process. With reference to FIG. 7D, the parting line 274 of the rear lateral lobe 230 may terminate at or near the rear longitudinal axis 276, and the parting line 274 of the front lateral lobe 234 may terminate at or near the front longitudinal axis 278. For example, the parting line 274 of the rear lateral lobe 230 may terminate at a lower region of the fluid-filled chamber component 204—at or near the bottom surface 252 of the fluid-filled chamber component 204. Similarly, the parting line 274 of the front lateral lobe 234 may terminate at an upper region of the fluid-filled chamber component 204—at or near the top surface 250 of the fluid-filled chamber component 204. As such, the parting line 274 extends arcuately (e.g., transverse to the top or bottom surfaces 250, 252) from the front lateral lobe 234 to the rear lateral lobe 230. A similar relationship may be formed between the parting line 274 of the rear medial lobe 228 and the parting line 274 of the front medial lobe 232.

The membrane 254 can be transparent, translucent, and/or opaque. As used herein, the term "transparent" for a membrane and/or a fluid-filled chamber means that light passes through the membrane in substantially straight lines and a viewer can see through the membrane. In comparison, for an opaque membrane, light does not pass through the membrane and one cannot see clearly through the membrane at all. A translucent membrane falls between a transparent membrane and an opaque membrane, in that light passes through a translucent layer but some of the light is scattered so that a viewer cannot see clearly through the layer.

The membrane 254 can be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some implementations, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The chamber 256 can be produced using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the membrane 254 can be produced by co-extrusion followed by vacuum thermoforming to produce the chamber 256, which can be inflatable and which can optionally include one or more valves (e.g., one way valves) that allows chamber 256 to be filled with the fluid (e.g., gas).

The chamber 256 can be provided in a fluid-filled or in an unfilled state. The chamber 256 can be filled to include any suitable fluid, such as a gas or liquid. In an aspect, the gas can include air, nitrogen ($N_2$), or any other suitable gas. In other aspects, chamber 256 can alternatively include other media, such as pellets, beads, ground recycled material, and the like (e.g., foamed beads and/or rubber beads). The fluid provided to the chamber 256 can result in the chamber 256 being pressurized. Alternatively, the fluid provided to the chamber 256 can be at atmospheric pressure such that the chamber 256 is not pressurized but, rather, simply contains a volume of fluid at atmospheric pressure.

The chamber 256 desirably has a low gas transmission rate to preserve its retained gas pressure. In some implementations, the chamber 256 has a gas transmission rate for nitrogen gas that is at least about ten (10) times lower than a nitrogen gas transmission rate for a butyl rubber layer of substantially the same dimensions. In an aspect, the chamber 256 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the membrane 254). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

Figure 8:
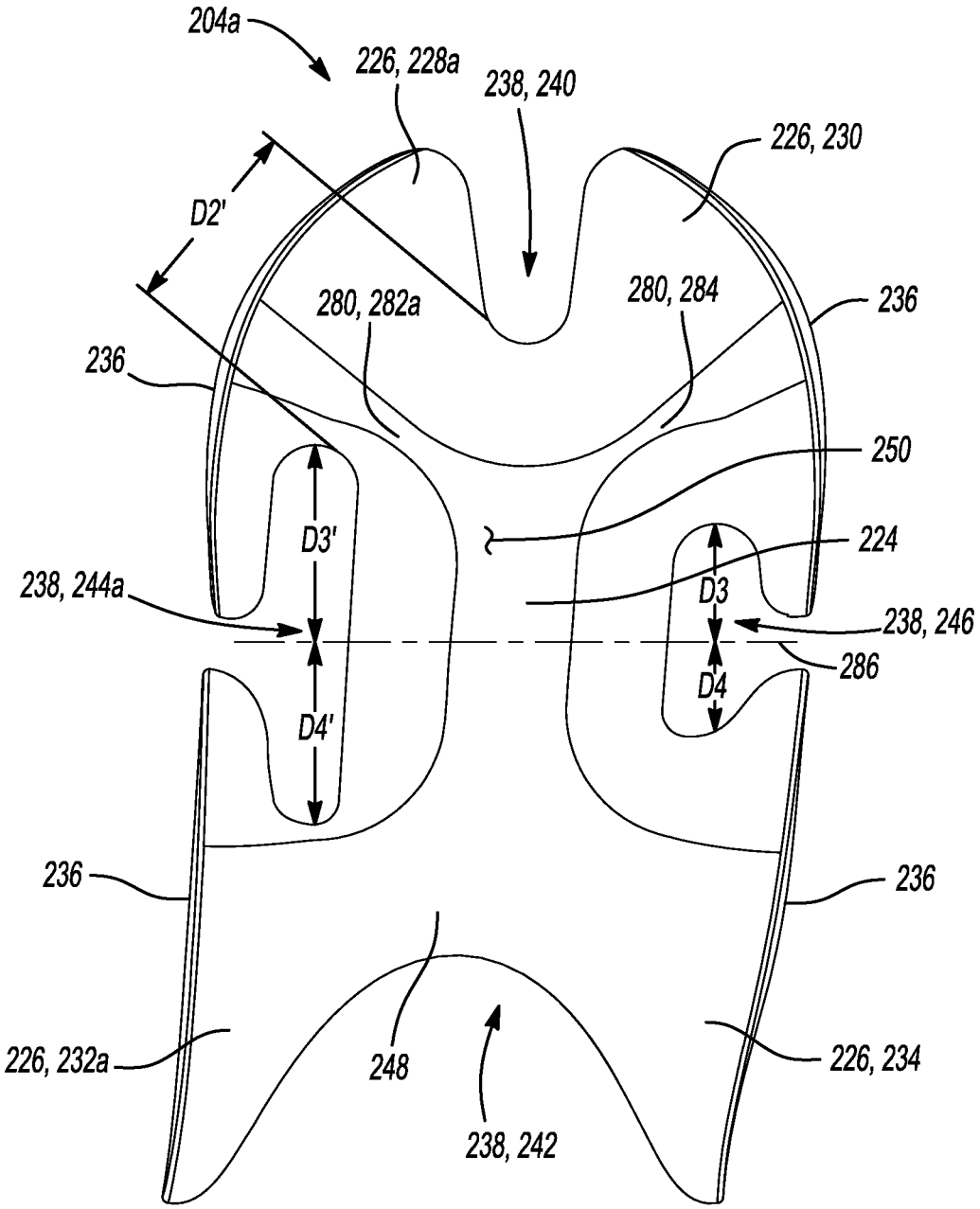
FIG. 8 is a plan view of a top of another fluid-filled chamber component of the article of footwear of FIG. 1.

With reference to FIG. 8, another example of a fluid-filled chamber component 204*a* for use with the article of footwear 10 (FIG. 1) is generally shown. In view of the substantial similarity in structure and function of the fluid-filled chamber component 204*a* with respect to the fluid-filled chamber component 204, like reference numerals are used hereinafter and in the drawings to identify like components while like reference numerals containing letter extensions or prime symbols are used to identify those components that have been modified.

A rear medial lobe 228*a* may have a different shape than the rear medial lobe 228. Similarly, a front medial lobe 232*a* may have a different shape than the front medial lobe 232, a medial channel 244*a* may have a different shape than the medial channel 244, and a rear medial tunnel 282*a* may have a different shape than the rear medial tunnel 282. In some implementations, the first distance D1 (FIG. 7E) extending between the top and bottom surfaces 250, 252 of the fluid-filled chamber component 204*a* is equal to a second distance D2' extending from the rear channel 240 to the medial channel 244*a* (e.g., an edge of the fluid-filled chamber component 204 defining the medial channel 244*a*) or to the lateral channel 246 (e.g., an edge of the fluid-filled chamber component 204 defining the lateral channel 246). At least one of a third distance D3' or a fourth distance D4' may be modified (e.g., increased or decreased) to modify the relationship between the second distance D2' and the first distance D1. For example, the third distance D3' and/or the fourth distance D4' may be increased relative to the third distance D3 and the fourth distance D4, to maintain a 1:1 ratio of the second distance D2' to the first distance D1. In so doing, the fluid-filled chamber component 204*a* includes a resulting structure that is asymmetrical about a central, longitudinal axis of the fluid-filled chamber component 204*a*. Further, the fluid-filled chamber component 204*a* also may be asymmetrical about a central, lateral axis that extends between a medial side of the fluid-filled chamber component 204*a* and a lateral side of the fluid-filled chamber component 204*a* (i.e., an axis that is substantially perpendicular to a longitudinal axis of the fluid-filled chamber component 204*a*) due to one or both distances D3', D4' being different than D3, D4, respectively. See, for example, FIG. 8.

As shown in FIGS. 1-5, the midsole component 202 may substantially inter-fit with the fluid-filled chamber component 204, 204*a* such that the bottom surface 222 of the midsole component 202 directly abuts the top surface 250 of the fluid-filled chamber component 204, 204*a* in the heel region 24. That is, the projections 208, 210, 212, 214, 216 of the midsole component 202 may be disposed within the channels 238, 240, 242, 244/244*a*, 246 of the fluid-filled chamber component 204, 204*a* such that the projections 208, 210, 212, 214, 216 inter-fit with the lobes 226, 228, 230, 232, 234. Each of the projections 208, 210, 212, 214, 216 may have a shape that generally corresponds to the shape of a corresponding channel 238, 240, 242, 244/244*a*, 246. For example, the rear projection 210 may inter-fit with the rear channel 240, the front projection 212 may inter-fit with the front channel 242, the medial projection 214 may inter-fit with the medial channel 244/244*a*, and the lateral projection 216 may inter-fit with the lateral channel 246. Each of the projections 208, 210, 212, 214, 216 may substantially fill the corresponding channel 238, 240, 242, 244/244*a*, 246. In particular, the rear projection 210 may substantially fill the rear channel 240, the front projection 212 may substantially fill the front channel 242, the medial projection 214 may substantially fill the medial channel 244/244*a*, and the lateral projection 216 may substantially fill the lateral channel 246.

With reference to FIGS. 1-5, during use, the outsole component 206 generally engages a ground surface and imparts traction to the article of footwear 10. In some implementations, the outsole component 206 is formed of a durable, wear-resistant material that engages a ground surface and imparts traction during use. In some implementations, the outsole component 206 includes a top, non-exposed surface 258 and at least one traction element 272 disposed on an exposed, ground-contacting surface 260 (opposite the non-exposed surface 258) to engage a ground surface and impart traction during use.

The outsole component 206 may be disposed below the midsole component 202 and the fluid-filled chamber component 204/204*a*, and may be formed of an abrasion resistant material suitable for contact with a ground surface. For example, the outsole component 206 may be disposed below the midsole component 202 and the fluid-filled chamber component 204/204*a* in the heel region 24 to protect these components from abrasive contact with a ground surface in the heel region 24 during heel-strike events, for example. Similarly, the outsole component 206 may be disposed below the midsole component 202 and/or the fluid-filled chamber component 204/204*a* in the forefoot region 20 to protect these components from abrasive contact with a ground surface during pivoting movements, for example.

As shown in FIGS. 4 and 5, the outsole component 206 may have a peripheral shape that generally corresponds to a peripheral shape of the midsole component 202. The outsole component 206 may have a lip 262 disposed on the top surface 258 near or in the mid-foot region 22. The lip 262 may receive the front medial lobe 232 and the front lateral lobe 234 of the fluid-filled chamber component 204/204*a*. For example, the lip 262 may prohibit the fluid-filled chamber component 204/204*a* from moving toward the forefoot region 20.

Similarly, the outsole component 206 may include a rear flange 264, a medial protrusion 266 and a lateral protrusion 268. The rear flange 264 may extend from the top surface 258 toward the midsole component 202, and the rear flange 264 may prohibit the fluid-filled chamber component 204/204*a* from moving beyond the anterior end 12. The medial protrusion 266 may engage the medial channel 244 of the fluid-filled chamber component 204/204*a* and the lateral protrusion 268 may engage the lateral channel 246 of the fluid-filled chamber component 204/204*a*. The medial protrusion 266 and the lateral protrusion 268 may prohibit movement of the fluid-filled chamber component 204/204*a* relative to the outsole component 206.

In an assembled configuration, as shown in FIGS. 1-3, portions of the bottom surface 222 of the midsole component 202 disposed on the projections 208, 210, 212, 214, 216 may extend through the channels 238, 240, 242, 244/244*a*, 246 and directly abut the top surface 258 of the outsole component 206. For example, each of the projections 208, 210, 212, 214, 216 may include a distal surface 270 disposed on the bottom surface 222 of the midsole component 202. The distal surfaces 270 may extend through the channels 238, 240, 242, 244/244*a*, 246 and directly abut the outsole component 206. For example, the distal surface 270 of the rear projection 210 may abut the rear flange 264 of the outsole component 206, the distal surface 270 of the front projection 212 may abut the top surface 258 of the outsole component 206, the distal surface 270 of the medial projection 214 may abut the medial protrusion 266 of the outsole component 206, and the distal surface 270 of the lateral projection 216 may abut the lateral protrusion 268 of the outsole component 206.

As set forth above, the sole structure 200, including the midsole component 202, the fluid-filled chamber component 204/204*a*, and the outsole component 206 may provide inflation and performance characteristics suitable for attenuating impact and ground reaction forces associated with a heel region of article of footwear 10, such as a heel strike portion of a running stride.

The following Clauses provide an exemplary configuration for a sole structure for an article of footwear described above.

Clause 1: A sole structure for an article of footwear, the sole structure comprising a midsole having a plurality of projections, at least one of the plurality of projections forming a first portion of a peripheral side wall of the sole structure and a fluid-filled chamber having a central portion, a plurality of lobes extending outward from the central portion, and a plurality of channels formed between the plurality of lobes, a first lobe of the plurality of lobes disposed between at least two of the plurality of projections such that the first lobe forms a second portion of the peripheral side wall of the sole structure.

Clause 2: The sole structure according to Clause 1, wherein the plurality of channels includes a first channel and a second channel, the first lobe defining a first distance extending between the first channel and the second channel and a second distance extending from a bottom surface of the fluid-filled chamber to a top surface of the fluid-filled chamber, the first distance being substantially equal to the second distance.

Clause 3: The sole structure according to Clause 1, wherein the midsole includes an upper surface and a lower surface opposite the upper surface, the plurality of projections disposed within the plurality of channels from a top surface of the fluid-filled chamber to a bottom surface of the fluid-filled chamber, and wherein exposed side walls of the plurality of projections form the first portion of the peripheral side wall of the sole structure.

Clause 4: The sole structure according to Clause 1, wherein the plurality of lobes each define a distal end wall and the plurality of projections each define an exposed side wall, a plurality of the distal end walls and a plurality of the exposed side walls alternating in an inter-fitted configuration to form the peripheral side wall of the sole structure.

Clause 5: The sole structure according to Clause 4, wherein the at least some of the distal end walls are flush with at least some of the exposed side walls to form the peripheral side wall.

Clause 6: The sole structure according to Clause 4, wherein the at least some of the distal end walls are offset from at least some of the exposed side walls to form the peripheral side wall of the sole structure.

Clause 7: The sole structure according to Clause 1, further comprising an outsole having an exposed surface and a non-exposed surface opposite the exposed surface, wherein the fluid-filled chamber engages a first portion of the non-exposed surface, and the midsole engages a second portion of the non-exposed surface of the outsole.

Clause 8: The sole structure according to Clause 7, wherein the outsole includes a lip disposed in a mid-foot region of the sole structure and configured to inhibit movement of the fluid-filled chamber toward a forefoot region of the sole structure.

Clause 9: The sole structure according to Clause 7, wherein the outsole includes at least one protrusion disposed within at least one of the plurality of channels.

Clause 10: The sole structure according to Clause 9, wherein the midsole engages the at least one protrusion.

Clause 11: The sole structure according to Clause 1, wherein the fluid-filled chamber includes a membrane defining a fluid-filled chamber and the midsole is non-hollow.

Clause 12: The sole structure according to Clause 1, wherein the fluid-filled chamber is tapered between a posterior end and an anterior end of the sole structure.

Clause 13: A sole structure for an article of footwear, the sole structure comprising a fluid-filled chamber having a central portion and a plurality of lobes extending outward from the central portion, the plurality of lobes forming a first portion of a peripheral side wall of the sole structure and a midsole having a plurality of projections inter-fitted with the plurality of lobes and forming a second portion of the peripheral side wall of the sole structure.

Clause 14: The sole structure according to Clause 13, wherein the plurality of lobes define a first channel and a second channel, a first lobe of the plurality of lobes defining a first distance extending between the first channel and the second channel and a second distance extending from a bottom surface of the fluid-filled chamber to a top surface of the fluid-filled chamber, the first distance being substantially equal to the second distance.

Clause 15: The sole structure according to Clause 14, wherein the midsole includes an upper surface and a lower surface opposite the upper surface, at least one of the plurality of projections disposed between two lobes of the plurality of lobes from the top surface to the bottom surface, and wherein exposed side walls of the plurality of projections form the first portion of the peripheral side wall of the sole structure.

Clause 16: The sole structure according to Clause 13, wherein the plurality of lobes each define a distal end wall and the plurality of projections each define an exposed side wall, a plurality of the distal end walls and a plurality of the exposed side walls alternating in an inter-fitted configuration to form the peripheral side wall of the sole structure.

Clause 17: The sole structure according to Clause 16, wherein the at least some of the distal end walls are flush with at least some of the exposed side walls to form the peripheral side wall.

Clause 18: The sole structure according to Clause 16, wherein the at least some of the distal end walls are offset from at least some of the exposed side walls to form the peripheral side wall of the sole structure.

Clause 19: The sole structure according to Clause 13, further comprising an outsole having an exposed surface and a non-exposed surface opposite the exposed surface, wherein the fluid-filled chamber engages a first portion of the non-exposed surface, and the midsole engages a second portion of the non-exposed surface of the outsole.

Clause 20: The sole structure according to Clause 19, wherein the outsole includes a lip disposed in a mid-foot region of the sole structure and configured to inhibit movement of the fluid-filled chamber toward a forefoot region of the sole structure.

Clause 21: The sole structure according to Clause 19, wherein the outsole includes at least one protrusion disposed between at least two of the plurality of lobes.

Clause 22: The sole structure according to Clause 21, wherein the midsole engages the at least one protrusion.

Clause 23: The sole structure according to Clause 13, wherein the fluid-filled chamber includes a membrane defining a fluid-filled chamber and the midsole is non-hollow.

Clause 24: The sole structure according to Clause 13, wherein the fluid-filled chamber is tapered between a posterior end and an anterior end of the sole structure.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a midsole having a plurality of projections, at least one of the plurality of projections forming a first portion of a peripheral side wall of the sole structure; and a fluid-filled chamber located in a heel region of the sole structure and being asymmetric about a central axis extending between a medial side of the fluid-filled chamber and a lateral side of the fluid-filled chamber, the fluid-filled chamber having a central portion, a plurality of lobes extending outward from the central portion and between respective projections of the plurality of projections to form a second portion of the peripheral side wall of the sole structure, a plurality of tunnels fluidly coupling respective lobes of the plurality of lobes to the central portion, a plurality of channels defined by adjacent lobes of the plurality of lobes and adjacent tunnels of the plurality of tunnels, at least one channel of the plurality of channels having a different shape than an adjacent channel of the plurality of channels, the plurality of channels including a lateral side channel and a medial side channel, both the lateral side channel and the medial side channel including a T-shape, a length of one of the lateral side channel and the medial side channel along a central, longitudinal axis of the fluid-filled chamber being shorter than a length of the other of the lateral side channel and the medial side channel along the central, longitudinal axis, and a parting line defining an exposed edge extending arcuately along the peripheral side wall of the sole structure from a first terminal end at an upper region of the fluid-filled chamber to a second terminal end at a bottom region of the fluid-filled chamber, the fluid-filled chamber being asymmetric about the central, longitudinal axis of the fluid-filled chamber, the central, longitudinal axis extending along a length of the sole structure from an anterior end to a posterior end, wherein at least one lobe of the plurality of lobes includes a thickness at a first end that tapers continuously in a direction from the heel region toward a forefoot region to a thickness at a second end that is less than the thickness at the first end.

2. The sole structure of claim 1, wherein the plurality of lobes includes a first lobe, a second lobe, a third lobe, and a fourth lobe, at least two of the first lobe, the second lobe, the third lobe, and the fourth lobe including the same shape.

3. The sole structure of claim 2, wherein the other two of the first lobe, the second lobe, the third lobe, and the fourth lobe (i) include a different shape than the at least two of the first lobe, the second lobe, the third lobe, and the fourth lobe and (ii) have the same shape as one another.

4. The sole structure of claim 2, wherein the at least two of the first lobe, the second lobe, the third lobe, and the fourth lobe are disposed on opposite sides of the fluid-filled chamber.

5. The sole structure of claim 2, wherein the first lobe, the second lobe, the third lobe, and the fourth lobe extend around the heel region of the sole structure.

6. The sole structure of claim 2, wherein the first lobe defines a rear longitudinal axis along a peripheral side surface of the first lobe, and the second lobe defines a front longitudinal axis along a peripheral side surface of the second lobe, the rear longitudinal axis being parallel to the front longitudinal axis.

7. The sole structure of claim 6, wherein the rear longitudinal axis and the front longitudinal axis are disposed at non-orthogonal angles relative to a bottom surface of the fluid-filled chamber and oppose one another.

8. The sole structure of claim 1, wherein each tunnel of the plurality of tunnels includes approximately the same size and shape.

9. An article of footwear incorporating the sole structure of claim 1.

10. The sole structure of claim 1, wherein the lateral side channel includes a first opening at the peripheral side wall and the medial side channel includes a second opening at the peripheral side wall, the length of the lateral side channel extending substantially parallel to the central, longitudinal axis of the fluid-filled chamber and having a midpoint that is offset from a midpoint of the first opening and the length of the medial side channel extending substantially parallel to the central, longitudinal axis of the fluid-filled chamber and having a midpoint that is offset from a midpoint of the second opening.

11. A sole structure for an article of footwear, the sole structure comprising:

a midsole having a plurality of projections, at least one of the plurality of projections forming a first portion of a peripheral side wall of the sole structure; and a fluid-filled chamber located in a heel region of the sole structure and being asymmetric about a central, lateral axis extending between a medial side of the fluid-filled chamber and a lateral side of the fluid-filled chamber, the fluid-filled chamber having a central portion, a plurality of lobes extending outward from the central portion and between respective projections of the plurality of projections to form a second portion of the peripheral side wall of the sole structure, a plurality of tunnels fluidly coupling respective lobes of the plurality of lobes to the central portion, a plurality of channels defined by adjacent lobes of the plurality of lobes and adjacent tunnels of the plurality of tunnels, at least one channel of the plurality of channels having a different size than an adjacent channel of the plurality of channels, the plurality of channels including a lateral side channel and a medial side channel, both the lateral side channel and the medial side channel including a T-shape, a length of one of the lateral side channel and the medial side channel along a central, longitudinal axis of the fluid-filled chamber being shorter than a length of the other of the lateral side channel and the medial side channel along the central, longitudinal axis, and a parting line defining an exposed edge extending arcuately along the peripheral side wall of the sole structure from a first terminal end at an upper region of the fluid-filled chamber to a second terminal end at a bottom region of the fluid-filled chamber, the fluid-filled chamber being asymmetric about the central, longitudinal axis of the fluid-filled chamber, the central, longitudinal axis extending along a length of the sole structure from an anterior end to a posterior end, wherein at least one lobe of the plurality of lobes includes a thickness at a first end that tapers continuously in a direction from the heel region toward a forefoot region to a thickness at a second end that is less than the thickness at the first end.

12. The sole structure of claim 11, wherein at least one channel of the plurality of channels has a different shape than an adjacent channel of the plurality of channels.

13. The sole structure of claim 11, wherein the plurality of lobes includes a first lobe, a second lobe, a third lobe, and a fourth lobe, at least two of the first lobe, the second lobe, the third lobe, and the fourth lobe including the same shape.

14. The sole structure of claim 13, wherein the other two of the first lobe, the second lobe, the third lobe, and the fourth lobe (i) include a different shape than the at least two of the first lobe, the second lobe, the third lobe, and the fourth lobe and (ii) have the same shape as one another.

15. The sole structure of claim 13, wherein the at least two of the first lobe, the second lobe, the third lobe, and the fourth lobe are disposed on opposite sides of the fluid-filled chamber.

16. The sole structure of claim 13, wherein the first lobe, the second lobe, the third lobe, and the fourth lobe extend around the heel region of the sole structure.

17. The sole structure of claim 11, wherein each tunnel of the plurality of tunnels includes approximately the same size and shape.

18. An article of footwear incorporating the sole structure of claim 11.

* * * * *